US005238506A

United States Patent [19]

Cape et al.

[11] Patent Number: 5,238,506

[45] Date of Patent: Aug. 24, 1993

[54] PHOSPHATE COATING COMPOSITION AND METHOD OF APPLYING A ZINC-NICKEL-MANGANESE PHOSPHATE COATING

[75] Inventors: Thomas W. Cape, West Bloomfield; Harry R. Charles, Mt. Clemens, both of Mich.

[73] Assignee: Chemfil Corporation, Troy, Mich.

[21] Appl. No.: 877,348

[22] Filed: Apr. 30, 1992

Related U.S. Application Data

[60] Continuation of Ser. No. 471,179, Jan. 26, 1990, abandoned, which is a continuation-in-part of Ser. No. 242,986, Sep. 12, 1988, Pat. No. 4,941,930, which is a division of Ser. No. 912,754, Sep. 26, 1986, Pat. No. 4,793,867.

[51] Int. Cl.[5] ..... C23C 22/18

[52] U.S. Cl. ..... 148/262

[58] Field of Search ..... 148/262

[56] References Cited

U.S. PATENT DOCUMENTS

| | | | |
|---|---|---|---|
| 4,330,345 | 5/1982 | Miles | 148/262 |
| 4,419,199 | 12/1983 | Hauffe et al. | 204/181 R |
| 4,427,459 | 1/1984 | Goltz | 148/6.15 R |
| 4,486,241 | 12/1984 | Denofri | 148/262 |
| 4,596,607 | 6/1986 | Huff et al. | 148/6.15 Z |
| 4,670,066 | 6/1987 | Schapira et al. | 148/6.15 Z |
| 4,678,519 | 7/1987 | Schapira et al. | 148/6.15 Z |
| 4,681,641 | 7/1987 | Zurellg | 148/262 |
| 4,793,867 | 12/1988 | Charles | 148/262 |
| 4,849,031 | 7/1989 | Hauffe et al. | 148/260 |

FOREIGN PATENT DOCUMENTS

| | | | |
|---|---|---|---|
| 228881 | 7/1958 | Australia . | |
| 82564/82 | 3/1983 | Australia . | |
| 533374 | 11/1983 | Australia . | |
| 18340/83 | 2/1986 | Australia . | |
| 81507/82 | 8/1986 | Australia . | |
| 557507 | 12/1986 | Australia . | |
| 18841 | 11/1980 | European Pat. Off. . | |
| 60716 | 9/1982 | European Pat. Off. . | |
| 135622 | 4/1985 | European Pat. Off. . | |
| 228151 | 7/1987 | European Pat. Off. . | |
| 1172741 | 10/1958 | France . | |
| 53-142934 | 12/1978 | Japan . | |
| 58-84979 | 5/1983 | Japan . | |
| 60-50175 | 3/1985 | Japan . | |
| 0204889 | 10/1985 | Japan | 148/262 |
| 63-227786 | 9/1988 | Japan . | |
| 00386 | 2/1984 | PCT Int'l Appl. . | |
| 03089 | 7/1985 | PCT Int'l Appl. . | |
| 963540 | 7/1964 | United Kingdom . | |
| 2226829 | 7/1990 | United Kingdom . | |

*Primary Examiner*—Sam Silverberg
*Attorney, Agent, or Firm*—William J. Uhl

[57] ABSTRACT

This invention relates to a method of coating metal surfaces including zinc-coated steel with zinc, nickel and manganese phosphate crystals for the purposes of improving paint adhesion, corrosion resistance, and resistance to alkali solubility. Potassium, sodium, or ammonium ions present as a phosphate salt are combined with zinc ions and nickel and manganese ions in relative proportions to cause the nickel and manganese ions to form a crystalline coating on the surface in combination with the zinc and phosphate.

7 Claims, 14 Drawing Sheets

ELECTROZINC-IRON

PERCENTAGE NICKEL IN PHOSPHATE COATING
2.0
1.0
0.0
0.0
200
400
600
800
NICKEL IN THE PHOSPHATE BATH
LOW ZINC IMMERSION
LOW ZINC SPRAY
HIGH ZINC IMMERSION
HIGH ZINC SPRAY

ELECTROZINC - IRON
PERCENTAGE NICKEL IN THE COATING
4.0
3.0
2.0
1.0
0.0
0.0
0.5
1.0
NICKEL / ZINC RATIO IN THE BOUNDRY LAYER

COMPARISON OF THE ALKALINE SOLUBILITY OF THE PHOSPHATE COATINGS ON HOT DIP GALVANIZED

THE DEPENDANCE OF CORROSION ON NICKEL/ZINC RATIO IN THE BOUNDRY LAYER FOR HOT DIP GALVANIZED

COMPARISON OF THE ALKALINE SOLUBILITY OF THE PHOSPHATE COATINGS ON ELECTROZINC-IRON

THE DEPENDANCE OF CORROSION ON NICKEL/ZINC IN THE BOUNDRY LAYER FOR ELECTROZINC-IRON

PHOSPHATE COATING COMPOSITION AND METHOD OF APPLYING A ZINC-NICKEL-MANGANESE PHOSPHATE COATING

This application is a continuation of application Ser. No. 07/471,179, filed Jan. 26, 1990, now abandoned, which is a continuation-in-part of application Ser. No. 07/242,986, filed Sep. 12, 1988, now U.S. Pat. No. 4,941,930, which is a division of application U.S. Ser. No. 06/912,754, filed Sep. 26, 1986, now U.S. Pat. No. 4,793,867.

FIELD OF THE INVENTION

The present invention relates to a composition and method of applying an alkali-resistant phosphate coating on metal substrates which include zinciferrous coatings. More particularly, the present invention relates to nickel-manganese-zinc phosphate conversion coating compositions prepared from concentrates wherein a substantially saturated solution, having a balance of monovalent non-coating metal ions and divalent coating metal ions, such as zinc, nickel and manganese form a coating upon the metal substrates.

BACKGROUND OF THE INVENTION

Conversion coatings are used to promote paint adhesion and improve the resistance of painted substrates to corrosion. One type of conversion coating is a zinc phosphate conversion coating which is composed primarily of hopeite [$Zn_3(PO_4)_2$]. Zinc phosphate coatings formed primarily of hopeite are soluble in alkali solutions. Such conversion coatings are generally painted which prevents the conversion coating from dissolving. However, if the paint coating is chipped or scratched, the zinc phosphate coating is then exposed and subject to attack by alkaline solutions such as salt water. When the conversion coating is dissolved, the underlying substrate is subject to corrosion.

In the design and manufacture of automobiles, a primary objective is to produce vehicles which have more than five-year cosmetic corrosion resistance. To achieve this objective, the percentage of zinc-coated steels used in the manufacture of vehicle bodies has continually increased. The zinc-coated steels currently used include hot-dip galvanized, galvanneal, electrozinc and electrozinc-iron coated steels. Such zinc coatings present problems relating to maintaining adequate paint adhesion. Adhesion to zinc-coated steel, uncoated steel and aluminum substrates can be improved by providing a phosphate conversion coating. To be effective in vehicle manufacturing apparitions, a conversion coating must be effective on uncoated steel, coated steel and aluminum substrates.

An improved zinc phosphate conversion coating for steel is disclosed in U.S. Pat. No 4,330,345 to Miles et al. In the Miles patent, an alkali metal hydroxide is used to suppress hopeite crystal formation and encourage the formation of phosphophyllite [$FeZn_2(PO_4)_2$] crystal, or zinc-iron phosphate, on the surface of the steel panels. The phosphophyllite improve corrosion resistance by reducing the alkaline solubility of the coating. The alkaline solubility of the coating is reduced because iron ions from the surface of the steel panels are included with zinc in the conversion coating.

The formation of a zinc-iron crystal in a phosphate conversion coating is possible on steel substrates by providing a high ratio of alkali metal to zinc. The alkali metal suppresses the formation of hopeite crystals and allows the acid phosphate solution to draw iron ions from the surface of the substrate and bond to the iron ions in the boundary layer or reaction zone formed at the interface between the bath and the substrate. This technique for creating a phosphophyllite-rich phosphate conversion coating is not applicable to substrates which do not include iron ions.

The predominance of zinc-coated metal used in new vehicle designs interferes with the formation of phosphophyllite in accordance with the Miles patent. Generally, the zinc-coated panels do not provide an adequate source of iron ions to form phosphophyllite. It is not practical to form phosphophyllite crystals by the addition of iron ions to the bath solution due to the tendency of the iron to precipitate from the solution causing unwanted sludge in the bath. A need exists for a phosphate conversion coating process for zinc-coated substrates which yields a coating having reduced alkaline solubility.

In U.S. Pat. No. 4,596,607 and Canadian Patent No. 1,199,588 to Zurilla et al., a method of coating galvanized substrates to improve resistance to alkali corrosion attack is disclosed wherein high levels of nickel are incorporated into a zinc phosphate conversion coating solution. The Zurilla process uses high zinc and nickel levels in the zinc phosphating coating compositions to achieve increased resistance to alkaline corrosion attack. The nickel concentration of the bath, as disclosed in Zurilla, is 85 to 94 mole percent of the total zinc-nickel divalent metal cations with a minimum of 0.2 grams per liter, i.e., 200 parts per million (ppm), zinc ion concentration in the bath solution. The extremely high levels of nickel and zinc disclosed in Zurilla result in high material costs on the order of three to five times the cost of prior zinc phosphate conversion coatings for steel. Also, the high zinc and nickel levels result in increased waste disposal problems since the zinc and nickel content of the phosphate coating composition results in higher levels of such metal being dragged through to the water rinse stage following the coating stage. Reference is also made to U.S. Pat. No. 4,595,424.

It has also been proposed to include other divalent metal ions in phosphate conversion coatings such as manganese. However, one problem with the use of manganese is that it is characterized by multiple valence states. In valence states other than the divalent state, manganese tends to oxidize and precipitate, forming a sludge in the bath instead of coating the substrate. The sludge must be filtered from the bath to prevent contamination of the surface.

A primary object of the present invention is to increase the alkaline corrosion resistance of phosphate conversion coatings applied to zinc-coated metals. By increasing the resistance of the phosphate coating to alkaline corrosion attack, it is anticipated that the ultimate objective of increasing corrosion resistance of vehicles to more than five years will be achieved.

Another objective is to improve the control of the phosphate coating process so that an effective coating, which is both corrosion-resistant and adhesion-promoting, can be consistently applied to steel, aluminum and zinc-coated panels. As part of this general objective, the control of a phosphate coating process including manganese is desired wherein sludge formation is minimized.

A further objective of the present invention is to reduce the quantity of metal ions transferred to a waste disposal system servicing the rinse stage of the phosphate conversion coating line. By reducing the quantity of metal ions transferred to waste disposal, the overall environmental impact of the process is minimized. Another important objective of the present invention is to provide a conversion coating which satisfies the above objectives while not unduly increasing the cost of the conversion coating process.

SUMMARY OF THE INVENTION

This invention relates to a method forming a phosphate conversion coating on a metal substrate in which a coating composition comprising zinc, another divalent cation such as nickel, and manganese, and a non-coating, monovalent metal cation. The invention improves the alkaline solubility of conversion coatings applied to zinc-coated substrates and produces a coating having a favorable crystal structure and good paint adhesion characteristics.

According to the method of the present invention, three essential components of the conversion coating bath are maintained within relative proportions to obtain a preferred crystal structure, referred to as "Phosphonicollite" [$Zn_2Ni(PO_4)_2$] or "Phosphomangollite" [$Zn_2Mn(PO_4)_2$], which are considered trademarks of the assignee. A phosphonicollite is a zinc-nickel phosphate which has superior alkaline solubility characteristics as compared to hopeite crystals characteristic of other phosphate conversion coatings, the essential constituents being grouped as follows:

A - potassium, sodium, or ammonium ions present as a phosphate;

B - zinc ions; and

C - nickel or nickel and manganese.

The quantity of zinc ions in the coating composition at bath dilution is between 300 and 1000 rpm. The ratios in which the essential constituents may be combined may range broadly from about 4–40 parts A; two parts B:2–13 parts C. A preferred range of the ratios of essential ingredients is 8–20 parts A:two parts B:2–3 parts C with the preferred quantity of zinc being between 500 and 700 ppm. Optimum performance has been achieved when the essential constituents are combined in the relative proportions of about 16 parts A:2 parts B:3 parts C. All references to parts are to be construed as parts by weight unless otherwise indicated.

The method is preferably performed by supplementing the essential constituents with accelerators, complexing agents, surfactants and the like and is initially prepared as a two-part concentrate as follows:

TABLE I

| | CONCENTRATE A | | | |
|---|---|---|---|---|
| | Raw Material | Most Preferred Range % | Preferred Range % | Broad Range % |
| 1. | Water | 20% | 10–50% | 0–80% |
| 2. | Phosphoric Acid (75%) | 38% | 20–45% | 10–60% |
| 3. | Nitric Acid | 21% | 5–25% | 2–35% |
| 4. | Zinc Oxide | 5% | 4–9% | 2–15% |
| 5. | Nickel Oxide | 8% | 3–18% | 1.5–25% |
| 6. | Sodium Hydroxide | 4% | 0–6% | 0–10% |
| 7. | Ammonium Bifluoride | 2% | 0.2–5% | 0–10% |
| 8. | Sodium salt of 2 ethyl hexyl sulfate | 0.3% | 0.2–0.5% | 0.1% |
| 9. | Nitro Benzene Sulfonic Acid | trace % | 0–trace % | 0–trace % |

TABLE II

| | CONCENTRATE B | | | |
|---|---|---|---|---|
| Raw Material | Chemical Family | Most Preferred Range % | Preferred Range % | Broad Range % |
| 1. Water | Solvent | 34% | 30–60% | 30–80% |
| 2. Phosphoric Acid (75%) | Acid | 28% | 20–35% | 10–35% |
| 3. Nitric Acid | Acid | 5% | 0–10% | 0–15% |
| 4. Sodium Hydroxide (50%) | Alkali | 13% | 0–30% | 0–30% |
| 5. Potassium Hydroxide (45%) | Alkali | 20% | 0–45% | 0–45% |

As used herein, all percentages are percent by weight and "trace" is about 0.05 to 0.1%.

According to the present invention, a phosphate coating bath comprising a substantially saturated solution of zinc, nickel and alkali metal or other monovalent non-coating ions results in the formation of a nickel-enriched phosphate coating having improved alkaline solubility characteristics. The surprising result realized by the method of the present invention is that as the zinc concentration of the coating bath decreases, the nickel content of the resulting coating is increased without increasing the concentration of the nickel. This surprising effect is particularly evident at higher nickel concentrations. If the concentration of zinc is maintained at a high level of more than 1000 ppm, the increase in nickel in the coating per unit of nickel added to the bath is less than the baths wherein the zinc concentration is in the range of 300 to 1000 ppm.

While not wishing to be bound by theory, it is believed that the inclusion of nickel in the coating depends on the relative proportion of nickel and other divalent metal ions available for precipitation on the metal surface. The inclusion of nickel in the coating may be controlled by controlling the concentration of the divalent metal ions at the boundary layer. The relative proportion of ions must be controlled since different divalent metal ions have different precipitation characteristics. At the boundary layer, the zinc concentration is higher than the zinc bath concentration by an amount which can be approximated by calculation from the nickel to zinc ratio in the bath and the resultant coating composition. It has been determined that low zinc/high nickel phosphate coating solutions produce a higher nickel content in the phosphate coating than either high zinc/high nickel or low zinc/low nickel coating solutions.

According to another aspect of the present invention, a third divalent metal ion may be added to the coating solution to further improve the alkaline solubility characteristics of the resulting coating. The third divalent metal ion is preferably manganese. When manganese is included in the bath, the nickel content of the coating drops because the presence of manganese in the boundary layer competes with nickel for inclusion in the phosphate coating. Manganese is considerably less expensive than nickel and, therefore, a manganese/nickel/zinc phosphate coating solution may be the most cost-effect method of improving resistance to alkaline solubility. Alkaline solubility of manganese/nickel/phosphate coating is improved to the extent that the ammonium dichromate stripping process generally used to strip phosphate coatings is ineffective to remove the manganese/nickel/zinc phosphate coating completely.

Prior attempts to manufacture a manganese phosphate concentrate encountered a serious problem of unwanted precipitation that formed sludge which, in turn, must be removed. Adding manganese alkali, such as MnO, $MN(OH)_2$ or $MnCO_3$ to phosphoric acid results in the formation of a brownish sludge. According to the present invention, nitrogen-containing reducing agents such as sodium nitrite, hydrazine sulfate, or hydrozylamine sulfate eliminates the unwanted precipitation. The precise quantity of reducing agent required to eliminate precipitation depends upon the purity of the manganese alkali. The reducing agent must be added prior to the manganese and prior to any oxidizer. Hence, manganese can be employed in amounts that are significantly higher than employed heretofore and the manganese and nickel ion concentrations, in accordance with this invention can be above 1500 ppm.

DETAILED DESCRIPTION OF THE PREFERRED EMBODIMENTS

Figure 1:
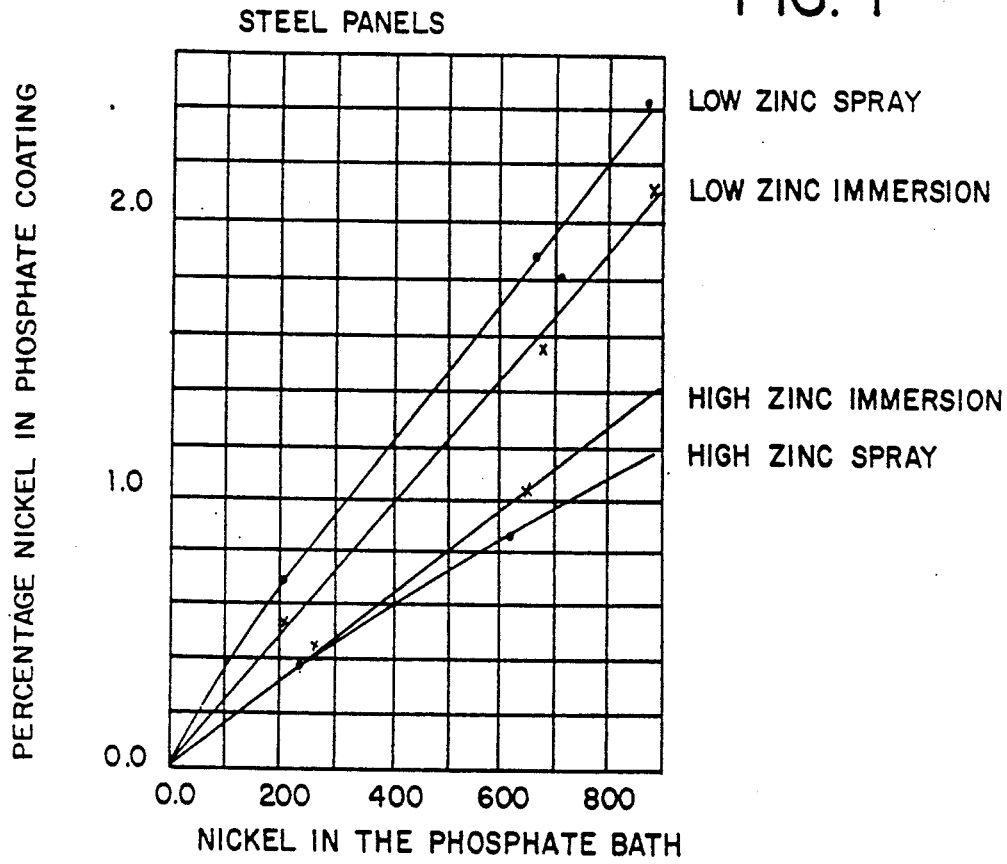
FIG. 1 graphically represents data from Table IV relating the nickel content of a phosphate coating to the nickel concentration in the corresponding phosphate bath. Two types of phosphate baths are compared. One has low zinc levels and the other has high zinc levels. The coatings are applied to steel panels such as used by the automotive industry for body panels.

The method of the present invention is generally referred to as phosphate conversion coating wherein a zinc phosphate solution is applied to metal substrates by spray or immersion. The metal substrate is first cleaned with an aqueous alkaline cleaner solution. The cleaner may include or be followed by a water rinse containing a titanium-conditioning compound. The cleaned and conditioned metal substrate is then sprayed or immersed in the phosphate bath solution of the present invention which is preferably maintained at a temperature between about 100° F. and 140° F. The phosphate coating solution preferably has a total acid content of between about 10 and 30 points and a free acid content of between about 0.5 and 1.0 points. The total acid to free acid ratio is preferably between about 10:1 and 60:1. The pH of the solution is preferably maintained between 2.5 and 3.5. Nitrites may be present in the bath in the amount of about 0.5 to about 2.5 points.

Following application of the phosphate solution, the metal substrate is rinsed with water at an ambient temperature to about 100° F. for about one minute. The metal substrate is then treated with a sealer comprising a chromate or chromic acid-based corrosion inhibiting sealer at a temperature of between ambient and 120° F. for about one minute which is followed by a deionized water rinse at ambient temperature for about thirty seconds.

One benefit realized according to the present invention over high zinc phosphate baths is a reduction of the quantity of divalent metal ions transferred from the phosphate treatment step to the water rinse. A quantity of phosphating solution is normally trapped in openings in treated objects such as vehicle bodies. The trapped phosphating solution is preferably drained off at the rinse stage. According to the present invention, the total quantity of divalent metal ions is reduced, as compared to high zinc phosphate baths, by reducing the concentration of zinc ions. As the concentration is reduced, the total quantity of ions transferred from the phosphate stage to the rinse stage is reduced. The water run-off is them processed through a waste treatment system and the reduction in divalent metal ions removed at the rinse stage results in waste treatment savings.

The primary thrust of the present invention is an improvement in the coating step of the above process.

EXAMPLES

Example 1

A phosphating bath solution was prepared from two concentrates as follows:

| Name of Raw Material | CONCENTRATE A1 | CONCENTRATE B |
|---|---|---|
| Water | 29% | 34% |
| Phosphoric Acid | 36% | 28% |

-continued

| Name of Raw Material | CONCENTRATE A1 | CONCENTRATE B |
|---|---|---|
| (75%) | | |
| Nitric Acid (67%) | 18% | 5% |
| Zinc Oxide | 10% | — |
| Nickel Oxide | 4% | — |
| Sodium Hydroxide (50%) | — | 13% |
| Potassium Hydroxide (45%) | — | 20% |
| Sodium Salt of 2 Ethyl Hexyl Sulfate | <1% | — |
| Ammonium Bifluoride | 2% | — |
| Ammonium Hydroxide | <0.1% | — |
| Nitro Benzene Sulfonic Acid | <0.1% | — |

The above concentrates were diluted to bath concentration by adding 5 liters of Concentrate Al to 378.5 liters of water to which was added a mixture of 10 liters of Concentrate B. The above concentrates, after dilution, were combined and a sodium nitrite solution comprising 50 grams sodium nitrite in 378.5 liters of water which is added to the concentrate as an accelerator. The coating was spray-applied for 30 to 120 seconds or immersion-applied for 90 to 300 seconds in a temperature of 115° F. to 130° F. When no B concentrate is used, a total of 7 liters of concentrate is added to 378.5 liters of water. All the rest of the procedure is the same.

The use of an alkali metal phosphate in preparation of a zinc phosphate bath involves addition of a less acidic alkali metal phosphate concentrate to a more acidic bath prepared from a standard zinc phosphate concentrate. The higher pH of the alkali metal phosphate concentrate will cause precipitation of zinc phosphate during periods of inadequate mixing. The phosphate bath will have a lower zinc concentration when the alkali metal phosphate is added at a faster ate than when it is added at a slower rate. Variation in degree of precipitation will affect the free acid in that more precipitation will lead to higher free acid. Examples 7, 7a, 12, and 12a demonstrate that one concentrate can produce baths that react differently.

EXAMPLES 2–16

The following examples have been prepared in accordance with the method described in Example 1 above. Examples 3, 4 and 11 are control examples having a high zinc concentration which does not include Concentrate B, a source of alkali metal ions.

Examples including manganese are prepared by adding the specified quantity of the nitrogen-containing reducing agent to a phosphoric acid/water mixture. To this solution, a manganese-containing alkali, such as MnO, $Mn(OH)_2$and $Mn(CO_3)$ is added. If an oxidizer, such as nitric acid, is added to the bath, it is added subsequent to the addition of the manganese-containing alkali.

Examples 2 through 16 were prepared in accordance with Example 1 above. However, the coating compositions were changed in accordance with the following tables:

Example 2

| Name of Raw Material | CONCENTRATE A2 | CONCENTRATE B |
|---|---|---|
| Water | 35% | 34% |

-continued

| Name of Raw Material | CONCENTRATE A2 | CONCENTRATE B |
|---|---|---|
| Phosphoric Acid (75%) | 39% | 28% |
| Nitric Acid (67%) | 12% | 5% |
| Zinc Oxide | 5% | — |
| Nickel Oxide | 4% | — |
| Sodium Hydroxide (50%) | 2% | 13% |
| Potassium Hydroxide (45%) | — | 20% |
| Sodium Salt of 2 Ethyl Hexyl Sulfate | <1% | — |
| Ammonium Bifluoride | 2% | — |
| Ammonium Hydroxide | <0.1% | — |
| Nitro Benzene Sulfonic Acid | <0.1% | — |

Example 3

| Name of Raw Material | CONCENTRATE A3 |
|---|---|
| Water | 29% |
| Phosphoric Acid (75%) | 39% |
| Nitric Acid (67%) | 15% |
| Zinc Oxide | 11% |
| Nickel Oxide | 3% |
| Sodium Hydroxide (50%) | — |
| Potassium Hydroxide (45%) | — |
| Sodium Salt of 2 Ethyl Hexyl Sulfate | <1% |
| Ammonium Bifluoride | 2% |
| Ammonium Hydroxide | <0.1% |
| Nitro Benzene Sulfonic Acid | <0.1% |

Example 4

| Name of Raw Material | CONCENTRATE A4 | CONCENTRATE B |
|---|---|---|
| Water | 24% | 34% |
| Phosphoric Acid (75%) | 35% | 28% |
| Nitric Acid (67%) | 23% | 5% |
| Zinc Oxide | 10% | — |
| Nickel Oxide | 5% | — |
| Sodium Hydroxide (50%) | — | 13% |
| Potassium Hydroxide (45%) | — | 20% |
| Sodium Salt of 2 Ethyl Hexyl Sulfate | <1% | — |
| Ammonium Bifluoride | 2% | — |
| Ammonium Hydroxide | <0.1% | — |
| Nitro Benzene Sulfonic Acid | <0.1% | — |

Example 5

| Name of Raw Material | CONCENTRATE A5 | CONCENTRATE B |
|---|---|---|
| Water | 20% | 34% |
| Phosphoric Acid (75%) | 39% | 28% |
| Nitric Acid (67%) | 21% | 5% |
| Zinc Oxide | 5% | — |
| Nickel Oxide | 8% | — |
| Sodium Hydroxide (50%) | 4% | 13% |
| Potassium Hydroxide (45%) | — | 20% |
| Sodium Salt of 2 | <1% | — |

-continued

| Name of Raw Material | CONCENTRATE A5 | CONCENTRATE B |
|---|---|---|
| Ethyl Hexyl Sulfate | | |
| Ammonium Bifluoride | 2% | — |
| Ammonium Hydroxide | <0.1% | — |
| Nitro Benzene Sulfonic Acid | <0.1% | — |

Example 6

| Name of Raw Material | CONCENTRATE A6 | CONCENTRATE B |
|---|---|---|
| Water | 31% | 34% |
| Phosphoric Acid (75%) | 36% | 28% |
| Nitric Acid (67%) | 17% | 5% |
| Zinc Oxide | 4% | — |
| Nickel Oxide | 9% | — |
| Sodium Hydroxide (50%) | 1% | 13% |
| Potassium Hydroxide (45%) | — | 20% |
| Sodium Salt of 2 Ethyl Hexyl Sulfate | <1% | — |
| Ammonium Bifluoride | 1% | — |
| Ammonium Hydroxide | <0.1% | — |
| Nitro Benzene Sulfonic Acid | <0.1% | — |

Example 7

| Name of Raw Material | CONCENTRATE A7 | CONCENTRATE B |
|---|---|---|
| Water | 35% | 34% |
| Phosphoric Acid (75%) | 38% | 28% |
| Nitric Acid (67%) | 12% | 5% |
| Zinc Oxide | 4% | — |
| Nickel Oxide | 6% | — |
| Sodium Hydroxide (50%) | 3% | 13% |
| Potassium Hydroxide (45%) | — | 20% |
| Sodium Salt of 2 Ethyl Hexyl Sulfate | <1% | — |
| Ammonium Bifluoride | 1% | — |
| Ammonium Hydroxide | <0.1% | — |
| Nitro Benzene Sulfonic Acid | <0.1% | — |

Example 8

| Name of Raw Material | CONCENTRATE A8 | CONCENTRATE B |
|---|---|---|
| Water | 36% | 34% |
| Phosphoric Acid (75%) | 39% | 28% |
| Nitric Acid (67%) | 10% | 5% |
| Zinc Oxide | 5% | — |
| Nickel Oxide | 5% | — |
| Sodium Hydroxide (50%) | 3% | 13% |
| Potassium Hydroxide (45%) | — | 20% |
| Sodium Salt of 2 Ethyl Hexyl Sulfate | <1% | — |
| Ammonium Bifluoride | 1% | — |
| Ammonium Hydroxide | <0.1% | — |
| Nitro Benzene Sulfonic Acid | <0.1% | — |

Example 9

| Name of Raw Material | CONCENTRATE A9 |
|---|---|
| Water | 35% |
| Phosphoric Acid (75%) | 33% |
| Nitric Acid (67%) | 16% |
| Zinc Oxide | 8% |
| Nickel Oxide | 4% |
| Sodium Hydroxide (50%) | — |
| Potassium Hydroxide (45%) | — |
| Sodium Salt of 2 Ethyl Hexyl Sulfate | <1% |
| Ammonium Bifluoride | 1% |
| Ammonium Hydroxide | <0.1% |
| Nitro Benzene Sulfonic Acid | <0.1% |

Example 10

| Name of Raw Material | CONCENTRATE A9 | CONCENTRATE B |
|---|---|---|
| Water | 35% | 34% |
| Phosphoric Acid (75%) | 33% | 28% |
| Nitric Acid (67%) | 16% | 5% |
| Zinc Oxide | 8% | — |
| Nickel Oxide | 4% | — |
| Sodium Hydroxide (50%) | — | 13% |
| Potassium Hydroxide (45%) | — | 20% |
| Sodium Salt of 2 Ethyl Hexyl Sulfate | <1% | — |
| Ammonium Bifluoride | 1% | — |
| Ammonium Hydroxide | <0.1% | — |
| Nitro Benzene Sulfonic Acid | <0.1% | — |

Example 11

| Name of Raw Material | CONCENTRATE A10 |
|---|---|
| Water | 36% |
| Phosphoric Acid (75%) | 39% |
| Nitric Acid (67%) | 11% |
| Zinc Oxide | 11% |
| Nickel Oxide | 1% |
| Sodium Hydroxide (50%) | — |
| Potassium Hydroxide (45%) | — |
| Sodium Salt of 2 Ethyl Hexyl Sulfate | <1% |
| Ammonium Bifluoride | 1% |
| Ammonium Hydroxide | <0.1% |
| Nitro Benzene Sulfonic Acid | <0.1% |

Example 12

| Name of Raw Material | CONCENTRATE A10 | CONCENTRATE B |
|---|---|---|
| Water | 36% | 34% |
| Phosphoric Acid (75%) | 39% | 28% |
| Nitric Acid (67%) | 11% | 5% |
| Zinc Oxide | 11% | — |
| Nickel Oxide | 1% | — |
| Sodium Hydroxide (50%) | — | 13% |
| Potassium Hydroxide (45%) | — | 20% |
| Sodium Salt of 2 Ethyl Hexyl Sulfate | <1% | — |

-continued

| Name of Raw Material | CONCENTRATE A10 | CONCENTRATE B |
|---|---|---|
| Ammonium Bifluoride | 1% | — |
| Ammonium Hydroxide | <0.1% | — |
| Nitro Benzene Sulfonic Acid | <0.1% | — |

Example 13

| Name of Raw Material | CONCENTRATE A10 | CONCENTRATE B |
|---|---|---|
| Water | 37% | 34% |
| Phosphoric Acid (75%) | 39% | 28% |
| Nitric Acid (67%) | 11% | 5% |
| Zinc Oxide | 11% | — |
| Nickel Oxide | 1% | — |
| Sodium Hydroxide (50%) | — | 13% |
| Potassium Hydroxide (45%) | — | 20% |
| Sodium Salt of 2 Ethyl Hexyl Sulfate | <1% | — |
| Ammonium Bifluoride | 1% | — |
| Ammonium Hydroxide | <0.1% | — |
| Nitro Benzene Sulfonic Acid | <0.1% | — |

Example 14

| Name of Raw Material | CONCENTRATE A12 | CONCENTRATE B |
|---|---|---|
| Water | 35% | 34% |
| Phosphoric Acid (75%) | 33% | 28% |
| Nitric Acid (67%) | 16% | 5% |
| Zinc Oxide | 8% | — |
| Nickel Oxide | 4% | — |
| Sodium Hydroxide (50%) | — | 13% |
| Potassium Hydroxide (45%) | — | 20% |
| Sodium Salt of 2 Ethyl Hexyl Sulfate | <1% | — |
| Ammonium Bifluoride | — | — |
| Ammonium Hydroxide | <0.1% | — |
| Nitro Benzene Sulfonic Acid | <0.1% | — |

As the bath is used on a commercial basis, the phosphate bath is replenished after a series of coatings. The bath will become enriched with nickel after a series of coatings because more zinc than nickel is contained in the phosphate coating. The replenishment solution should be formulated to maintain the desired monovalent metal ion to zinc ion to nickel ion concentration.

The above examples, when diluted to bath concentration, yield the following approximate ratios of alkali metal to zinc to nickel ions.

TABLE III

| Example No. | Alkali Metal Ion:Zinc Ion:Nickel Ion Ratio Table |
|---|---|
| 1 | 4.5:1:0.80 |
| 2 | 4.9:1:0.92 |
| 3 | 0.1:1:0.30 |
| 4 | 5.2:1:0.97 |
| 5 | 7.8:1:1.24 |
| 6 | 6.0:1:1.39 |
| 7 | 6.4:1:1.35 |
| 8 | 5.8:1:0.88 |

TABLE III-continued

| Example No. | Alkali Metal Ion:Zinc Ion:Nickel Ion Ratio Table |
|---|---|
| 9 | 0.1:1:0.57 |
| 11 | 0.1:1:0.20 |
| 12 | 5.0:1:0.27 |
| 12a | 9.4:1:0.55 |

Example 15

| Name of Raw Material | CONCENTRATE M1 | CONCENTRATE MB |
|---|---|---|
| Water | 29% | 34% |
| Phosphoric Acid (75%) | 36% | 28% |
| Nitric Acid (67%) | 19% | 5% |
| Zinc Oxide | 10% | — |
| Nickel Oxide | 1% | — |
| Manganese Oxide | 4% | — |
| Sodium Hydroxide (50%) | — | 13% |
| Potassium Hydroxide (45%) | — | 19% |
| Hydroxylamine Sulfate | <1% | — |
| Sodium Salt of 2 Ethyl Hexyl Sulfate | <1% | — |
| Ammonium Bifluoride | — | 1% |
| Ammonium Hydroxide | <0.1% | — |
| Nitro Benzene Sulfonic Acid | <0.1% | — |

Example 16

| Name of Raw Material | CONCENTRATE M2 | CONCENTRATE MB |
|---|---|---|
| Water | 24% | 34% |
| Phosphoric Acid (75%) | 36% | 28% |
| Nitric Acid (67%) | 23% | 5% |
| Zinc Oxide | 9% | — |
| Nickel Oxide | 3% | — |
| Manganese Oxide | 4% | — |
| Sodium Hydroxide (50%) | — | 13% |
| Potassium Hydroxide (45%) | — | 19% |
| Hydroxylamine Sulfate | <1% | — |
| Sodium Salt of 2 Ethyl Hexyl Sulfate | <1% | — |
| Ammonium Bifluoride | — | 1% |
| Ammonium Hydroxide | <0.1% | — |
| Nitro Benzene Sulfonic Acid | <0.1% | — |

TESTING

A series of test panel were coated with combinations of two-part coating solutions. The test panels included uncoated steel panels, hot-dip galvanized, electrozinc, galvanneal, and electrozinc-iron. The test panels were processed in a laboratory by alkaline cleaning, conditioning, phosphate coating, rinsing, sealing and rinsing to simulate the previously described manufacturing process. The panels were dried and painted with a cationic electrocoat primer paint. The panels were scribed with either an X or a straight line and then subjected to four different testing procedures, the General Motors Scab Cycle (GSC), Ford Scan Cycle (FSC), Automatic Scan Cycle (ASC), Florida Exposure Test, and the Outdoor Scab Cycle (OSC).

TEST METHODS

The GSC, or 140° F. indoor scab test, is a four-week test with each week of testing consisting of five 24-hour cycles comprising immersion in a 5% sodium chloride solution at room temperature followed by a 75-minute drying cycle at room temperature followed by 22.5 hours at 85% relative humidity at 140° F. The panels are maintained at 140° F. at 85% relative humidity over the two-day period to complete the week. Prior to testing, the test panels are scribed with a carbide-tipped scribing tool. After the testing cycle is complete, the scribe is evaluated by simultaneously scraping the paint and blowing with an air gun. The test results were reported as rated from 0, indicating a total paint loss, to 5, indicating no paint load.

The FSC test is the same as the GSC test except the test is for ten weeks, the temperature during the humidity exposure portion of the test is set at 120° F. and the scribe is evaluated by applying Scotch Brand 898 tape and removing it and rating as above.

The ASC test is comprised of 98 12-hour cycles wherein each cycle consists of a 4 ¾ hour 95° to 100° humidity exposure followed by a 15-minute salt fog followed by seven hours of low humidity (less than 50 percent humidity) drying at 120° F. The ASC test is evaluated in the same way as the FSC test.

The Florida exposure test is a three-month outdoor exposure facing the south and oriented at 5° from horizontal at an inland site in Florida. A salt mist is applied to the test panels twice a week. Panels are scribed per ASTM D-1654 prior to exposure and soaked in water for 72 hours following exposure. The panels are cross-hatched after soaking and tested according to ASTM D-3359 Method B.

The most reliable test is the OSC test wherein a six-inch scribe is made on one-half of a panel and the other half is preconditioned in a gravelometer in accordance with SAE J 400. The panel is then exposed to salt spray for 24 hours which is followed by deionized water immersion for 48 hours. The panel is then placed outside at a 45° angle southern exposure. A steel control panel, treated with the same conversion process except for the final rinse which was chrome (III) final rinse, is treated simultaneously in the same manner. When the control panel exhibits a corrosion scab of about six millimeters, the panels are soaked for 24 hours. The OSC is evaluated according to the same procedure used for the FSC and ASC tests are described previously.

The panels scribed with a crosshatch grid were used to evaluate adhesion performance. After cyclical testing, the panels were contacted by an adhesive tape which is removed and qualitatively evaluated depending upon the degree of removal of non-adhering film by the tape. The numerical rating for this test is based upon a five-pint scale ranging from a rating of 0 for no adhesion to 5 for perfect adhesion.

The above examples were tested for corrosion resistance and adhesion by the above-described test method.

Table IV shows the relationship of the percentages of nickel in the baths, the zinc level in the baths, and the percentage of nickel contained in the coatings for six different phosphate bath compositions as applied to steel, hot-dip galvanized, electrozinc, galvanneal, and electrozinc-iron by both the spray and immersion methods.

TABLE IV

| Type of Phosphate | Percentage of Nickel in Phosphate Coatings | | | | | |
|---|---|---|---|---|---|---|
| Concentrate Used | Low Zinc Low Nickel Example 12 | Low Zinc High Nickel Example 1 | Low Zinc High Nickel Example 2 | Low Zinc High Nickel Example 4 | High Zinc High Nickel Example 11 | High Zinc High Nickel Example 3 |
| Nickel Concentration | 208 ppm | 670 ppm | 708 ppm | 880 ppm | 250 ppm | 635 ppm |
| Spray Phosphate | | | | | | |
| Steel | 0.71% | 1.89% | 1.81% | 2.41% | 0.38% | 0.86% |
| Hot Dip Galvanized | 0.78% | 1.42% | 1.49% | 1.67% | 0.41% | 0.73% |
| Electrozinc | 0.49% | 1.39% | 1.40% | 1.49% | 0.36% | 0.64% |
| A01 Galvanneal | 0.59% | 1.43% | 1.69% | 1.76% | 0.40% | 0.74% |
| Electrozinc-iron | 0.62% | 1.36% | 1.39% | 1.52% | 0.40% | 0.64% |
| Immersion Phosphate | | | | | | |
| Steel | 0.53% | 1.56% | — | 2.12% | 0.43% | 1.05% |
| Hot Dip Galvanized | 1.15% | 2.10% | 2.10% | 2.23% | 0.82% | 1.20% |
| Electrozinc | 1.01% | 1.80% | 1.98% | 2.23% | 0.64% | 0.87% |
| A01 Galvanneal | 1.27% | 2.34% | 2.33% | 2.59% | 0.68% | 1.03% |
| Electrozinc-iron | 1.18% | 1.97% | 2.12% | 2.16% | 0.73% | 0.75% |

Figure 2:
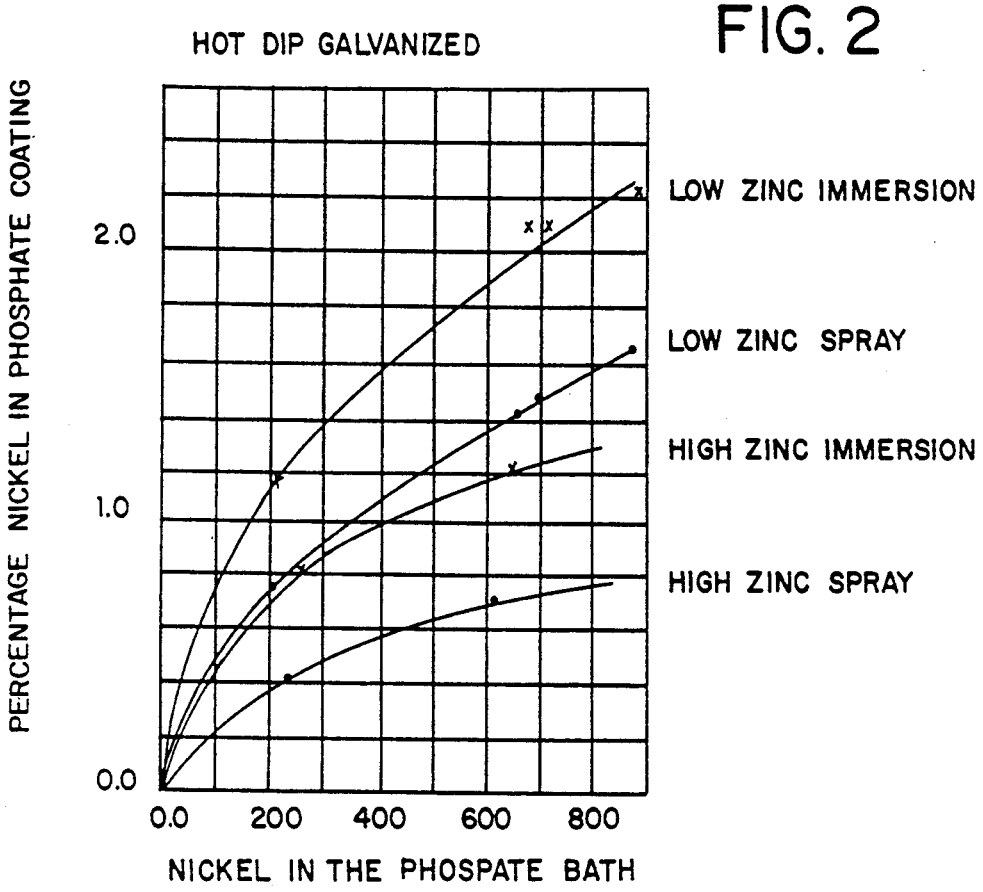
FIG. 2 graphically presents test data as in FIG. 1 as applied to hot-dip galvanized panels.
Figure 3:
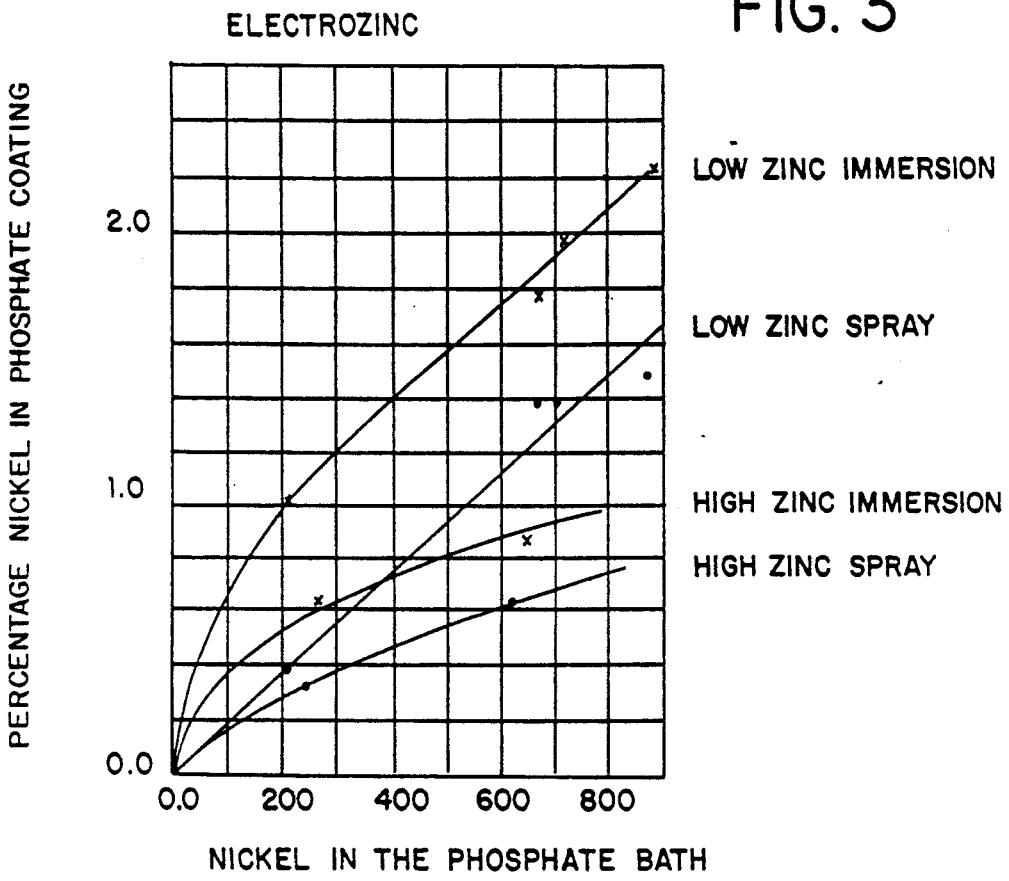
FIG. 3 graphically presents test data as in FIG. 1 as applied to electrozinc panels.
Figure 4:
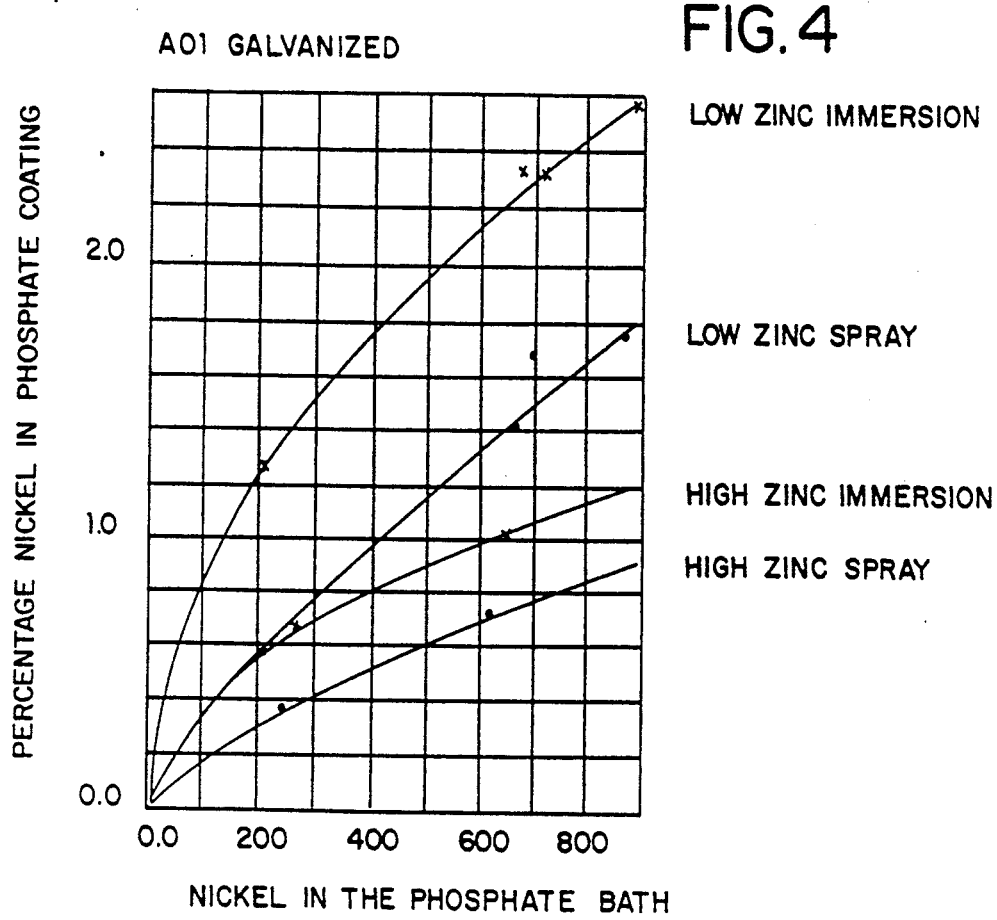
FIG. 4 graphically presents test data as in FIG. 1 as applied to electrozinc-iron panels.
Figure 5:
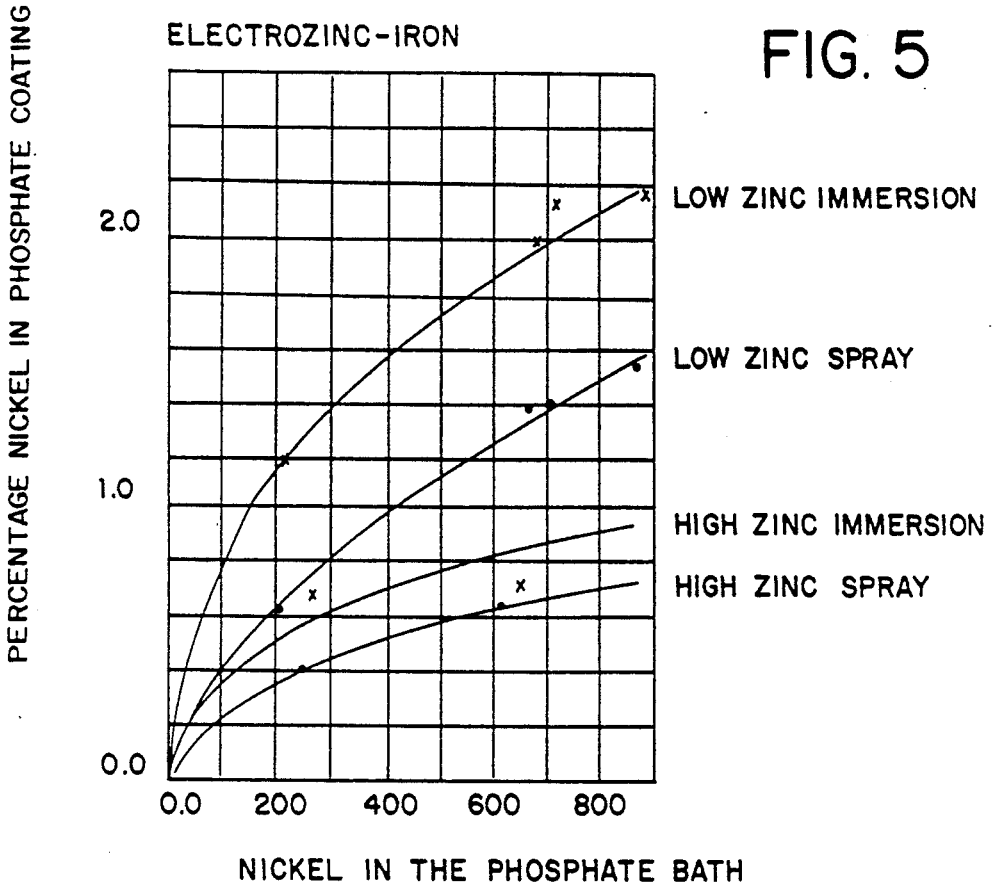

Referring to the above table, examples that are low zinc/high nickel phosphate yield the highest percentage of nickel in the phosphate coatings. Example 11, which is a low zinc/low nickel phosphate, has a lower percentage of nickel incorporated in the phosphate coating. Even lower levels of nickel incorporation are achieved when a high zinc/low nickel composition is used as shown in Example 10. The use of a high zinc/high nickel phosphate bath results in only slightly more nickel in the phosphate coating than in the low zinc/-low nickel bath and considerably less than any of the low zinc/high nickel baths. Thus, to obtain more nickel in the coating, the bath concentration of nickel should be high and the bath concentration of zinc should be low. The results are graphically presented in FIGS. 1-5 which clearly show that with either immersion or spray application methods, the low zinc formulations are more efficient in increasing nickel content of the phosphate coating than high zinc formulations. FIGS. 1-5 each relate to a different substrate material and the results achieved indicate that the low zinc formulations are preferable for all substrates.

For each of the above examples, the percentage of nickel in the phosphate coatings is shown in Table V below for the five tested substrates after immersion phosphating.

TABLE V

| Concentrates Used | Percentage of Nickel in Phosphate Coatings* | | | | |
|---|---|---|---|---|---|
| | Steel | Hot Dip Galvanized | Electrozinc | A01 Galvanneal | Electrozinc-Iron |
| Example 1 | 1.56% | 2.10% | 1.80% | 2.34% | 1.97% |
| Example 2 | — | 2.10% | 1.98% | 2.33% | 2.12% |
| Example 3 | 1.05% | 1.20% | 0.87% | 1.03% | 0.75% |
| Example 4 | 2.12% | 2.23% | 2.23% | 2.59% | 2.16% |
| Example 5 | 1.72% | 2.36% | 2.51% | 3.04% | 2.47% |
| Example 6 | 2.79% | 3.15% | 3.33% | 3.47% | 3.29% |
| Example 7 | 2.65% | 3.29% | 2.69% | 3.13% | 2.45% |
| Example 7a | 2.69% | 3.89% | 3.58% | 4.23% | 3.93% |
| Example 8 | 1.66% | 3.03% | 2.61% | 2.51% | 2.01% |

TABLE V-continued

| Concentrates Used | Percentage of Nickel in Phosphate Coatings* Steel | Hot Dip Galvanized | Electrozinc | A01 Galvanneal | Electrozinc-Iron |
|---|---|---|---|---|---|
| Example 9 | 1.56% | 2.36% | 1.68% | 1.74% | 1.62% |
| Example 11 | 0.43% | 0.82% | 0.64% | 0.68% | 0.73% |
| Example 12 | 0.53% | 1.15% | 1.01% | 1.27% | 1.18% |
| Example 12a | 0.59% | 1.15% | 0.98% | 1.18% | 1.05% |

*Immersion Phosphate

Again, the percentage of nickel in the phosphate coating is increased most effectively by the use of the low zinc/high nickel formulations such as Examples 1, 2, 4, 5, 6, 7, 7a and 8. The low nickel/high zinc is the least effective and the low nickel/low zinc or the high nickel/high zinc are only slightly more effective.

NICKEL/ZINC RATIO IN THE BOUNDARY LAYER

The proportion of nickel in the phosphate coating is proportional to the nickel/zinc ratio available for precipitation. Unfortunately, the ratio available for the precipitation is not the overall bath ratio but rather the ratio at the boundary layer between the metal surface and the bulk of the bath. For all substrates tested, high metal ion concentration in the boundary layer resulting from acid attack on the metal surface tended to lower the proportion of nickel available for precipitation. While it is not practical to measure metal ion concentrations at the boundary layer directly, the boundary layer concentrations can be calculated based on the linear correlation between the proportion of nickel in the coating and the nickel/zinc ratio. As the zinc concentration increases, the linear correlation coefficient is maximized at the boundary layer concentration. Furthermore, as the concentration of zinc is increased, the y-intercept should approach zero. These two criteria will be met only half the time each for application of this change to random data. Whether they follow the expected changes or not constitutes a test of the accuracy of the theory. For both criteria to be met for all five materials, there is a 99.9 percent chance that the theory is correct. In fact, all five materials met these criteria. The increase is metal ions in the boundary layer and the correlation coefficients are given in Table VI.

TABLE VI

| Metal Substrate | Difference Between Bath and Boundary Layer Zinc Concentrations: Extra Metal Ions In the Boundary Layer** | Correlation Coefficient* At Bath Concentration | At Boundary Layer Concentration |
|---|---|---|---|
| Steel | 1600 ppm | 0.906 | 0.989 |
| Hot Dip Galvanized | 450 ppm | 0.913 | 0.933 |
| Electrozinc | 300 ppm | 0.954 | 0.966 |
| A01 Galvanneal | 200 ppm | 0.976 | 0.982 |
| Electrozinc-Iron | 250 ppm | 0.946 | 0.954 |

*Correlation between percentage nickel in the phosphate coating and nickel to zinc ratio.
**Immersion Phosphate.

For hot-dip galvanized and electrozinc, the extra metal ions are zinc and hence can be added directly to the zinc concentration in the bath to obtain the zinc concentration in the boundary layer. However, for steel, the increase in concentration reflects an increase in the iron concentration. Since iron ions have a greater tendency to cause precipitation, the concentration of additional metal ions in the boundary layer of 1600 ppm is somewhat distorted. The ferrous ions compete more effectively than zinc ions for inclusion in the coating because phosphophyllite has a lower acid solubility than hopeite. This means that the determined concentration increase of 1600 ppm is greater than the actual ferrous ion concentration. The 1600 ppm represents the amount of zinc that would compete as effectively as the ferrous ions actually present and, therefore, can also be added directly to the bath concentration of zinc. A similar argument can be made for galvanneal and electrozinc-iron. The boundary layer rations can be calculated by the following equation:

$$\text{Nickel/zinc ratio In the boundary layer} = \frac{\text{Nickel in Bath}}{(\text{Zinc in bath} + \text{Extra metal ions in the boundary layer})}$$

Using this equation, nickel/zinc ratios in the boundary layers are calculated with the results shown in Table VIII below:

TABLE VII

| Concentrates Used | Nickel/Zinc Ratio in the Boundary Layer* Steel | Hot Dip Galvanized | Electrozinc | A01 Galvanneal | Electrozinc-Iron |
|---|---|---|---|---|---|
| Example 1 | 0.277 | 0.524 | 0.592 | 0.649 | 0.619 |
| Example 2 | 0.302 | 0.596 | 0.682 | 0.755 | 0.717 |
| Example 3 | 0.171 | 0.246 | 0.260 | 0.271 | 0.266 |
| Example 4 | 0.330 | 0.578 | 0.641 | 0.691 | 0.665 |
| Example 5 | 0.306 | 0.668 | 0.790 | 0.899 | 0.841 |
| Example 6 | 0.404 | 0.824 | 0.954 | 1.063 | 1.017 |
| Example 7 | 0.378 | 0.784 | 0.912 | 1.023 | 0.964 |
| Example 7a | 0.402 | 0.894 | 1.063 | 1.217 | 1.135 |
| Example 8 | 0.265 | 0.532 | 0.613 | 0.682 | 0.646 |
| Example 9 | 0.252 | 0.419 | 0.459 | 0.490 | 0.474 |
| Example 11 | 0.088 | 0.147 | 0.161 | 0.172 | 0.167 |
| Example 12 | 0.087 | 0.164 | 0.186 | 0.204 | 0.195 |
| Example 12a | 0.112 | 0.262 | 0.317 | 0.369 | 0.341 |

*Immersion Phosphate.

Figure 6:
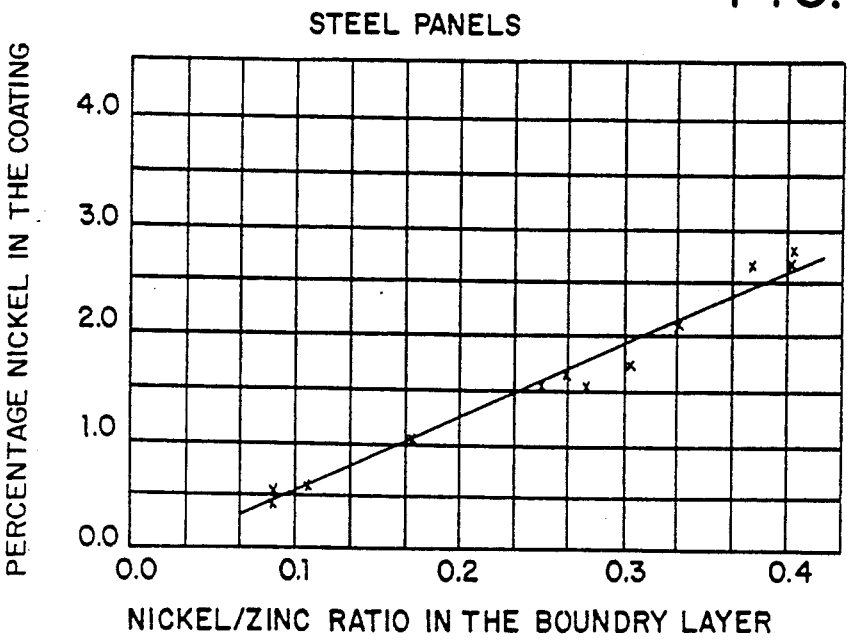
FIG. 6 graphically presents test data from Tables V and VII relating the ratio of nickel to zinc in the boundary layer to the percentage of nickel in the coating as applied to steel panels.
Figure 7:
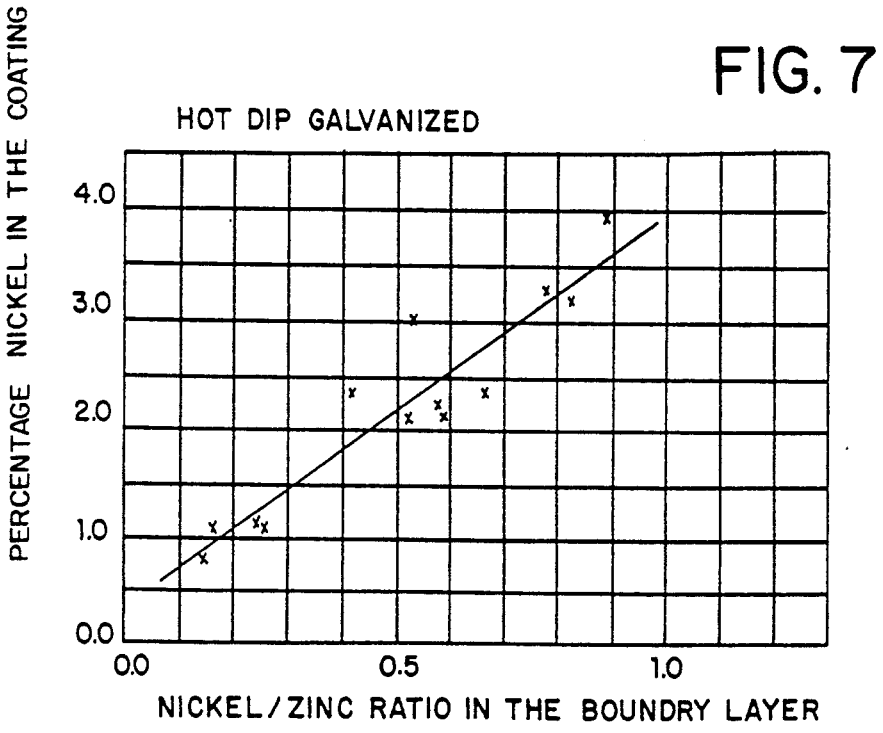
FIG. 7 graphically presents test data as in FIG. 6 as applied to hot-dip galvanized panels.
Figure 8:
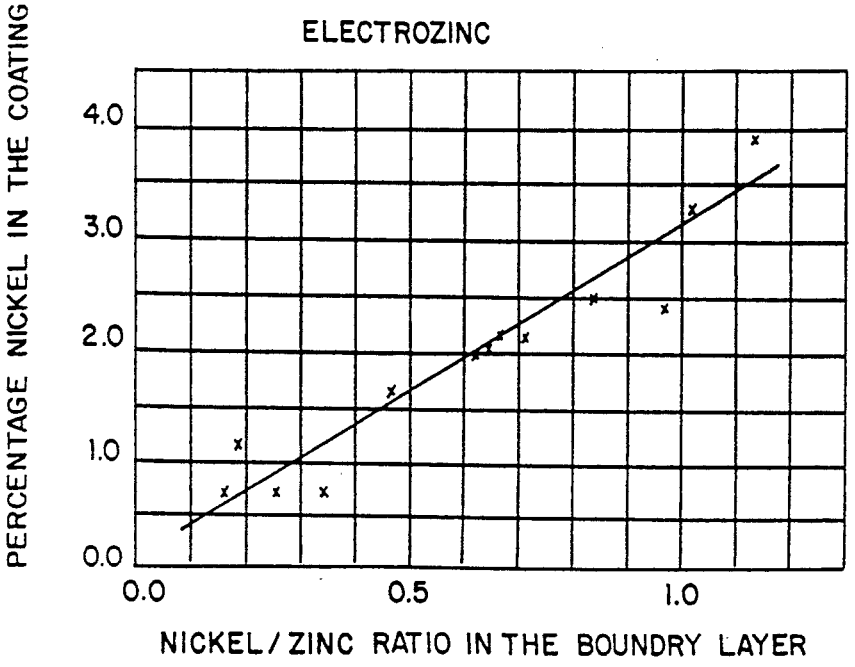
FIG. 8 graphically presents test data as in FIG. 6 as applied to electrozinc panels.
Figure 9:
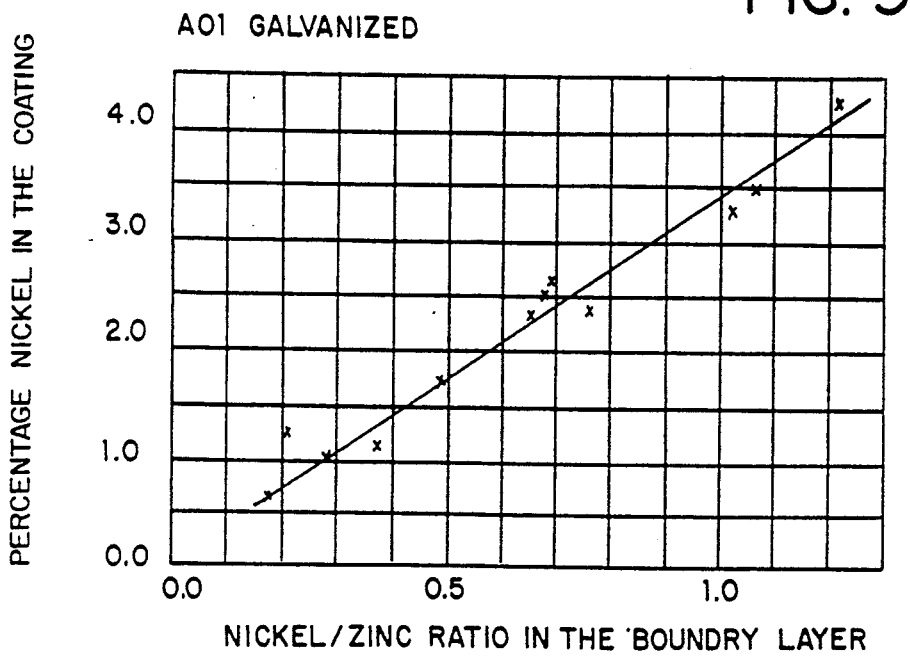
FIG. 9 graphically presents test data as in FIG. 6 as applied to galvanneal panels.
Figure 10:
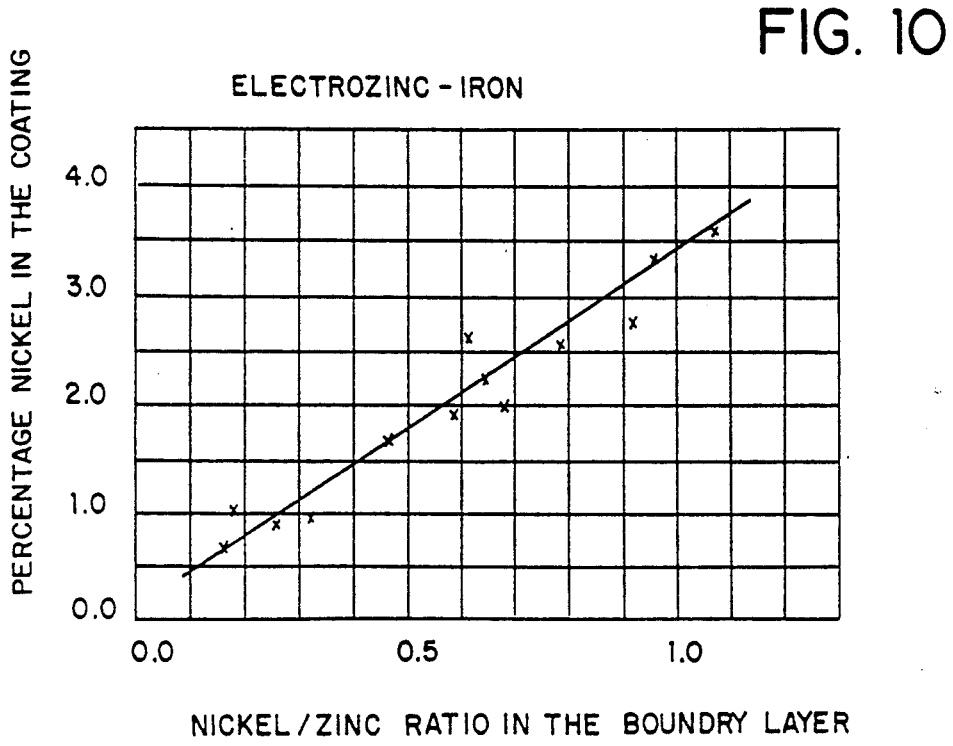
FIG. 10 graphically presents test data as in FIG. 6 as applied to electrozinc-iron panels.

FIGS. 6–10 show the correlation between the nickel/-ratio in the boundary layer and the percentage nickel in the coating.

FORMATION OF PHOSPHOPHYLLITE WITH A HIGH NICKEL PHOSPHATE

It has been previously established that higher phosphophyllite phosphate coating improves the painted corrosion resistance and paint adhesion on steel. In the previous section, it was shown that nickel competes with zinc for inclusion in the phosphate coating. It is critical to this invention that the inclusion of high phosphophyllite on iron-containing substrates is maintained at the high levels obtained with low zinc/low nickel baths. Data in Table VIII below shows that high nickel/low zinc phosphates have a phosphophyllite content equivalent to that of low nickel/low zinc phosphates. Notice that high zinc baths have lower phosphophyllite contents than the low zinc baths, even for the zinc-iron alloys, AOl galvanneal and electrozinc-iron. This will have important repercussions in the painted corrosion testing of these baths.

TABLE VIII

| Type of Phosphate | Percentage of Nickel in Phosphate Coatings | | | | | |
|---|---|---|---|---|---|---|
| Concentrate Used | Low Zinc Low Nickel Example 12 | Low Zinc High Nickel Example 1 | Low Zinc High Nickel Example 2 | Low Zinc High Nickel Example 4 | High Zinc Low Nickel Example 11 | High Zinc High Nickel Example 3 |
| Nickel Concentration | 208 ppm | 670 ppm | 708 ppm | 880 ppm | 250 ppm | 635 ppm |
| Spray Phosphate | | | | | | |
| Steel | 0.73% | 0.43% | 0.70% | 0.85% | 0.41% | 0.32% |
| A01 Galvanneal | 0.02% | 0.03% | 0.02% | 0.04% | 0.02% | 0.01% |
| Electrozinc-iron | 0.05% | 0.07% | 0.06% | 0.04% | 0.03% | 0.03% |
| Immersion Phosphate | | | | | | |
| Steel | 1.00% | 1.00% | — | 0.95% | 1.00% | 0.80% |
| A01 Galvanneal | 0.02% | 0.05% | 0.03% | 0.04% | 0.02% | 0.02% |
| Electrozinc-iron | 0.09% | 0.08% | 0.07% | 0.06% | 0.05% | 0.03% |

*P – ratio = (% Phosphophyllite)/(Hopeite + Phosphophyllite).

CORROSION AND ADHESION TEST RESULTS ence can be ascribed to lower phosphophyllite contents.

TABLE IX

| Type of Phosphate | 140° F. Indoor Scab test Results | | | | | | | | | |
|---|---|---|---|---|---|---|---|---|---|---|
| Concentrate Used | Low Zinc Low Nickel Example 12 | | Low Zinc High Nickel Example 1 | | Low Zinc High Nickel Example 2 | | Low Zinc High Nickel Example 4 | | High Zinc High Nickel Example 3 | |
| Nickel Concentration | 208 ppm | | 670 ppm | | 708 ppm | | 880 ppm | | 635 ppm | |
| | Scribe (mm) | Cross Hatch | Scribe (mm) | Cross Hatch | Scribe (mm) | Cross Hatch | Scribe (mm) | Cross Hatch | Scribe (mm) | Cross Hatch |
| Spray Phosphate | | | | | | | | | | |
| Steel | 4 mm | 5 | 4 mm | 5 | 4 mm | 5 | 4 mm | 5 | 5 mm | 3 |
| Hot Dip Galvanized | 5 mm | 3 | 4 mm | 4 | 3 mm | 4 | 3 mm | 5 | 4 mm | 4 |
| Electrozinc | 7 mm | 4 | 5 mm | 4 | 4 mm | 4+ | 4 mm | 5 | 8 mm | 4+ |
| A01 Galvanneal | 2 mm | 5 | 2 mm | 4+ | 2 mm | 5 | 1 mm | 5 | 4 mm | 5 |
| Electrozinc-Iron | 1 mm | 5 | 0 mm | 4+ | 1 mm | 5 | 0 mm | 5 | 4 mm | 1+ |
| Immersion Phosphate | | | | | | | | | | |
| Steel | 3 mm | 5 | 3 mm | 5 | 3 mm | 5 | 3 mm | 5 | 4 mm | 5 |
| Hot Dip Galvanized | 4 mm | 5 | 2 mm | 5 | 2 mm | 5 | 2 mm | 5 | 4 mm | 5 |
| Electrozinc | 6 mm | 5 | 4 mm | 5 | 4 mm | 5 | 4 mm | 5 | 4 mm | 5 |
| A01 Galvanneal | 2 mm | 5 | 2 mm | 5 | 2 mm | 5 | 1 mm | 5 | 3 mm | 5 |
| Electrozinc-Iron | 1 mm | 5 | 1 mm | 5 | 1 mm | 5 | 1 mm | 5 | 2 mm | 5 |

INDOOR SCAB TEST RESULTS

Table IX below shows the 140° F. indoor scab test results on five substrates with spray and immersion application processes. The low zinc/high nickel baths show improved corrosion and adhesion results when applied by the immersion process. The adhesion and corrosion test results are superior for Examples 1, 2 and 4 as compared to the high zinc/high nickel composition of Example 3 and the low zinc/low nickel composition of Example 12 for electrozinc and hot-dip galvanized. This difference is ascribed to the higher nickel content. Steel, AOl galvanneal and electrozinc-iron showed worse performance with Example 3 only. This difference can be ascribed to lower phosphophyllite contents.

In Table X below, the automatic scab test results for the same examples are shown. The automatic scab test shows improvement in corrosion resistance with high nickel/low zinc baths as compared to the other two for hot-dip galvanized and electrozinc. Steel and electrozinc-iron show decreased performance form the high zinc bath, undoubtedly because of lower phosphophyllite. On galvanneal, paint adhesion is adversely affected by high zinc baths but low nickel levels adversely affect corrosion resistance for all coated samples and equivalent results with uncoated steel. Variations from the general trend are believed to be unrelated to the expected effectiveness of the low zinc/high nickel compositions.

TABLE X

| Type of Phosphate | Automatic Scab Test Results | | | | | | | | | |
|---|---|---|---|---|---|---|---|---|---|---|
| Concentrate Used | Low Zinc Low Nickel Example 12 | | Low Zinc High Nickel Example 1 | | Low Zinc High Nickel Example 2 | | Low Zinc High Nickel Example 4 | | High Zinc High Nickel Example 3 | |
| Nickel Concentration | 208 ppm | | 670 ppm | | 708 ppm | | 880 ppm | | 635 ppm | |
| | Scribe (mm) | Cross Hatch | Scribe (mm) | Cross Hatch | Scribe (mm) | Cross Hatch | Scribe (mm) | Cross Hatch | Scribe (mm) | Cross Hatch |
| Spray Phosphate | | | | | | | | | | |
| Steel | 6 mm | 5 | 4 mm | 5 | 5 mm | 5 | 4 mm | 5 | 9 mm | 2+ |
| Hot Dip Galvanized | 3 mm | 1 | 2 mm | 2 | 3 mm | 3 | 2 mm | 5 | 4 mm | 3 |
| Electrozinc | 4 mm | 3+ | 4 mm | 2 | 4 mm | 4 | 3 mm | 5 | 4 mm | 4 |
| A01 Galvanneal | 4 mm | 4 | 4 mm | 4 | 4 mm | 5 | 3 mm | 4+ | 4 mm | 3+ |
| Electrozinc-Iron | 0 mm | 4 | 0 mm | 4 | 0 mm | 5 | 1 mm | 4 | 2 mm | 1 |
| Immersion Phosphate | | | | | | | | | | |
| Steel | 4 mm | 5 | 5 mm | 5 | 4 mm | 5 | 5 mm | 5 | 5 mm | 5 |
| Hot Dip Galvanized | 3 mm | 5 | 2 mm | 5 | 0 mm | 5 | 1 mm | 5 | 3 mm | 4+ |
| Electrozinc | 4 mm | 5 | 2 mm | 5 | 2 mm | 5 | 0 mm | 5 | 5 mm | 4 |

TABLE X-continued

| Type of Phosphate | Low Zinc Low Nickel | | Low Zinc High Nickel | | Low Zinc High Nickel | | Low Zinc High Nickel | | High Zinc High Nickel | |
|---|---|---|---|---|---|---|---|---|---|---|
| | Automatic Scab Test Results | | | | | | | | | |
| Concentrate Used | Example 12 | | Example 1 | | Example 2 | | Example 4 | | Example 3 | |
| Nickel Concentration | 208 ppm | | 670 ppm | | 708 ppm | | 880 ppm | | 635 ppm | |
| | Scribe (mm) | Cross Hatch | Scribe (mm) | Cross Hatch | Scribe (mm) | Cross Hatch | Scribe (mm) | Cross Hatch | Scribe (mm) | Cross Hatch |
| A01 Galvanneal | 7 mm | 5 | 4 mm | 5 | 0 mm | 5 | 2 mm | 5 | 2 mm | 3+ |
| Electrozinc-Iron | 0 mm | 5 | 0 mm | 5 | 1 mm | 4 | 0 mm | 5 | 2 mm | 3 |

A second automatic scab test was conducted for Examples 5–9 and 12a as shown in Table XI below. The test results showed improvement in adhesion for galvanneal and electrozinc-iron substrates for the low zinc-/high nickel compositions as compared to the low zinc/low nickel and high zinc/high nickel compositions. The corrosion test results indicated substantial improvement for hot-dip galvanized and electrozinc with the low zinc/high nickel formulations. Steel showed slight improvement with high nickel baths. The results of this test will be discussed in more detail in the section on alkaline solubility.

adhesion when compared to the other formulations when spray applied.

In summary, hot-dip galvanized and electro-zinc show consistent improvement with low zinc/high nickel phosphate baths over either low nickel/high nickel phosphate baths over either low nickel/low zinc or high nickel/high zinc baths. This is because of the increased nickel content in the phosphate coating. Electrozinc-iron and steel show an inconsistent or slight improvement related to the level of nickel in the phosphate coating, but a large improvement related to the level of phosphophyllite in the coating. Galvanneal

TABLE XI

| Type of Phosphate | Low Zinc Low Nickel | | Low Zinc High Nickel | | Low Zinc High Nickel | | Low Zinc High Nickel | | High Zinc High Nickel | | High Zinc High Nickel | |
|---|---|---|---|---|---|---|---|---|---|---|---|---|
| | Automatic Scab Test Results* | | | | | | | | | | | |
| Concentrates Used | Example 12a | | Example 5 | | Example 6 | | Example 7 | | Example 8 | | Example 9 | |
| | Scribe (mm) | Cross Hatch | Scribe (mm) | Cross Hatch | Scribe (mm) | Cross Hatch | Scribe (mm) | Cross Hatch | Scribe (mm) | Cross Hatch | Scribe (mm) | Cross Hatch |
| Steel | 6 mm | 5 | 4 mm | 5 | 4 mm | 4+ | 4 mm | 5 | 4 mm | 5 | 5 mm | 5 |
| Hot Dip Galvanized | 6 mm | 4 | 3 mm | 4+ | 2 mm | 5 | 3 mm | 4+ | 4 mm | 4+ | 5 mm | 4+ |
| Electrozinc | 2 mm | 5 | 1 mm | 5 | 1 mm | 5 | 0 mm | 5 | 1 mm | 5 | 2 mm | 5 |
| A01 Galvanneal | 2 mm | 4+ | 5 mm | 5 | 4 mm | 5 | 4 mm | 5 | 3 mm | 5 | 1 mm | 3 |
| Electrozinc-Iron | 2 mm | 2 | 2 mm | 3 | 1 mm | 5 | 2 mm | 4+ | 2 mm | 4 | 2 mm | 3 |

*Immersion Phosphate

Examples 1–4 and 12 were tested in Florida exposure with the results shown in Table XII below.

does not clearly show improvement related to Phosphonicolite or phosphophyllite levels in the coating.

TABLE XII

| Type of Phosphate | Low Zinc Low Nickel | | Low Zinc High Nickel | | Low Zinc High Nickel | | Low Zinc High Nickel | | High Zinc High Nickel | |
|---|---|---|---|---|---|---|---|---|---|---|
| | Automatic Scab Test Results | | | | | | | | | |
| Concentrates Used | Example 12 | | Example 1 | | Example 2 | | Example 4 | | Example 3 | |
| Nickel Concentration | 208 ppm | | 670 ppm | | 708 ppm | | 880 ppm | | 635 ppm | |
| | Scribe (mm) | Cross Hatch | Scribe (mm) | Cross Hatch | Scribe (mm) | Cross Hatch | Scribe (mm) | Cross Hatch | Scribe (mm) | Cross Hatch |
| Spray Phosphate | | | | | | | | | | |
| Steel | 3 mm | 5 | 3 mm | 5 | 2 mm | 5 | 2 mm | 5 | 6 mm | 2 |
| Hot Dip Galvanized | 6 mm | 2+ | 2 mm | 3 | 0 mm | 4 | 0 mm | 4 | 3 mm | 3 |
| Electrozinc | 1 mm | 2+ | 3 mm | 3 | 0 mm | 4 | 0 mm | 4 | 1 mm | 3 |
| A01 Galvanneal | 0 mm | 3 | 0 mm | 3+ | 0 mm | 4+ | 0 mm | 4+ | 0 mm | 2+ |
| Electrozinc-Iron | 0 mm | 4 | 0 mm | 4 | 0 mm | 4+ | 0 mm | 4+ | 9 mm | 1 |
| Immersion Phosphate | | | | | | | | | | |
| Steel | 2 mm | 5 | 2 mm | 5 | 2 mm | 5 | 2 mm | 5 | 3 mm | 5 |
| Hot Dip Galvanized | 0 mm | 4 | 0 mm | 4+ | 0 mm | 4+ | 0 mm | 4 | 1 mm | 4 |
| Electrozinc | 0 mm | 4 | 0 mm | 4 | 0 mm | 4 | 0 mm | 4 | 0 mm | 2+ |
| A01 Galvanneal | 0 mm | 4 | 0 mm | 4+ | 0 mm | 4+ | 0 mm | 5 | 0 mm | 3 |
| Electrozinc-Iron | 1 mm | 3 | 0 mm | 4 | 0 mm | 4 | 1 mm | 3 | 1 mm | 3 |

The Florida exposure test results show increased corrosion resistance or paint adhesion of the low zinc-/high nickel compositions on electrozinc, galvanneal, and hot-dip galvanized when compared to the low zinc/low nickel or high zinc/high nickel compositions. Superior corrosion resistance and paint adhesion was observed on electrozinc-iron and steel for low zinc as compared to high zinc/high nickel. In particular, Examples 2 and 4 shows excellent corrosion resistance and In the following section, this data will be related to the solubility of the phosphate coating in an alkaline media.

ALKALINE SOLUBILITIES OF PHOSPHATE COATINGS

Figure 11:
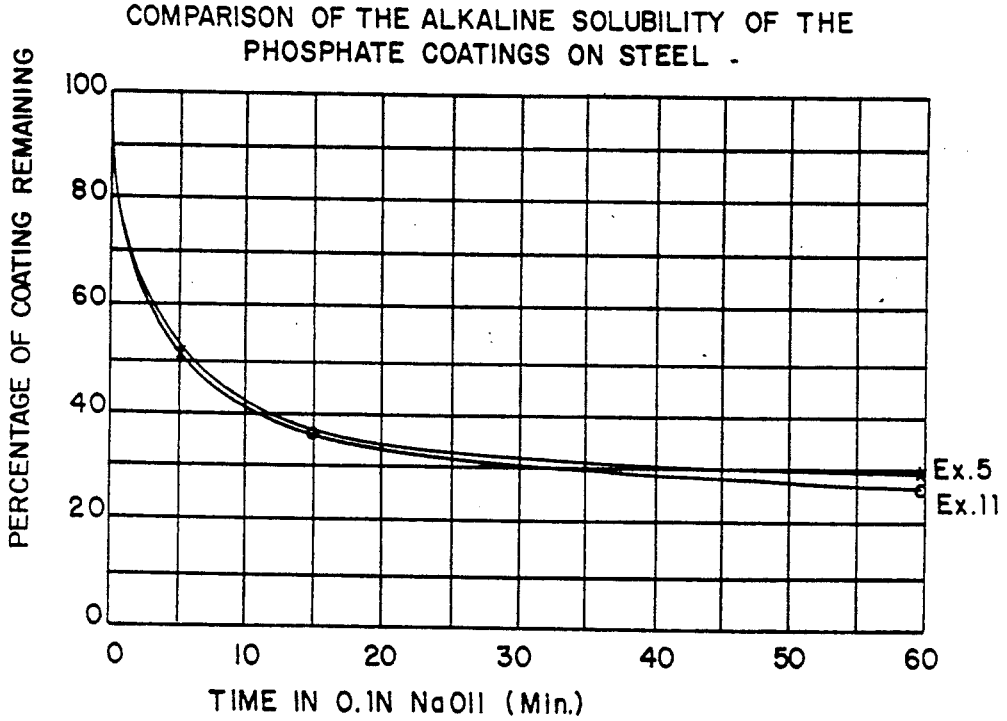
FIG. 11 graphically presents test data showing the improvement in alkaline solubility realized by increasing the nickel concentration in a phosphate bath as applied to steel panels.
Figure 12:
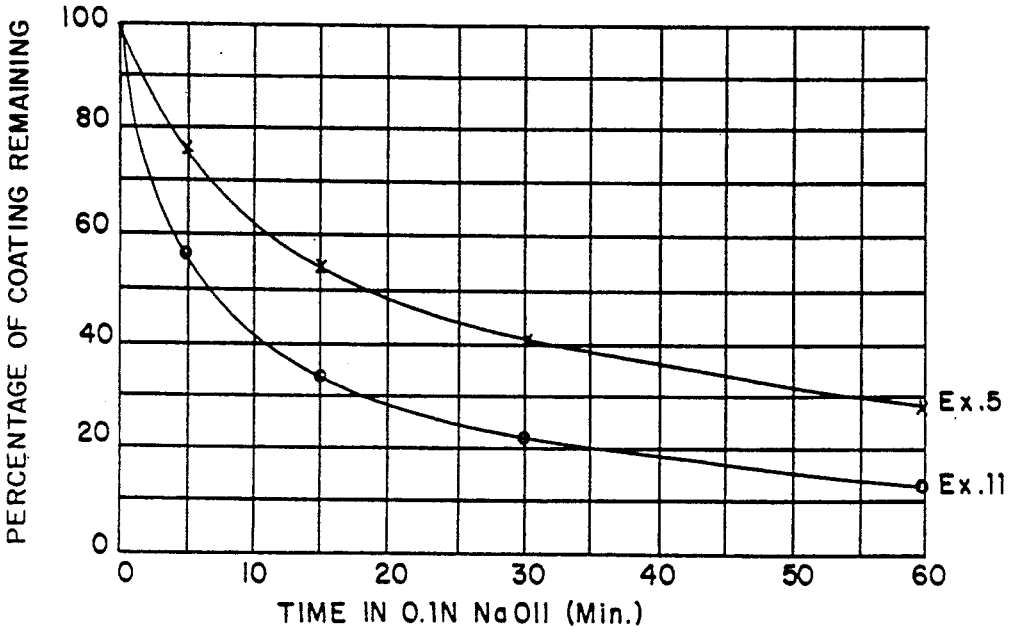
FIG. 12 graphically presents test data as in FIG. 11 as applied to hot-dip galvanized panels.
Figure 13:
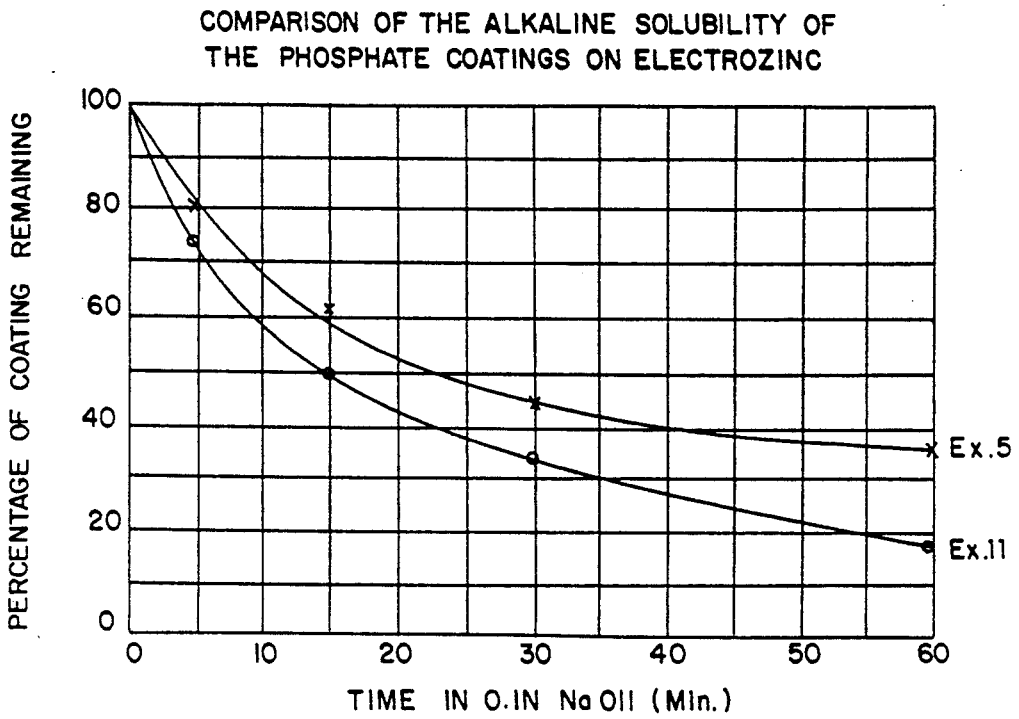
FIG. 13 graphically presents test data as in FIG. 11 as applied to electrozinc panels.
Figure 14:
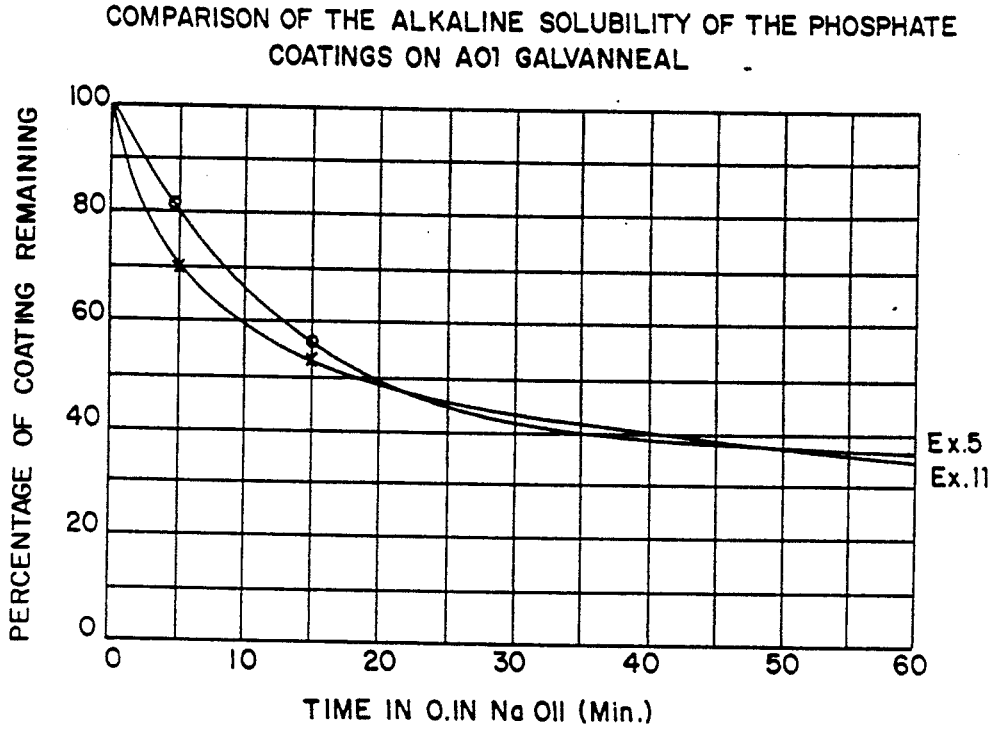
FIG. 14 graphically presents test data as in FIG. 11 as applied to galvanneal panels.
Figure 15:
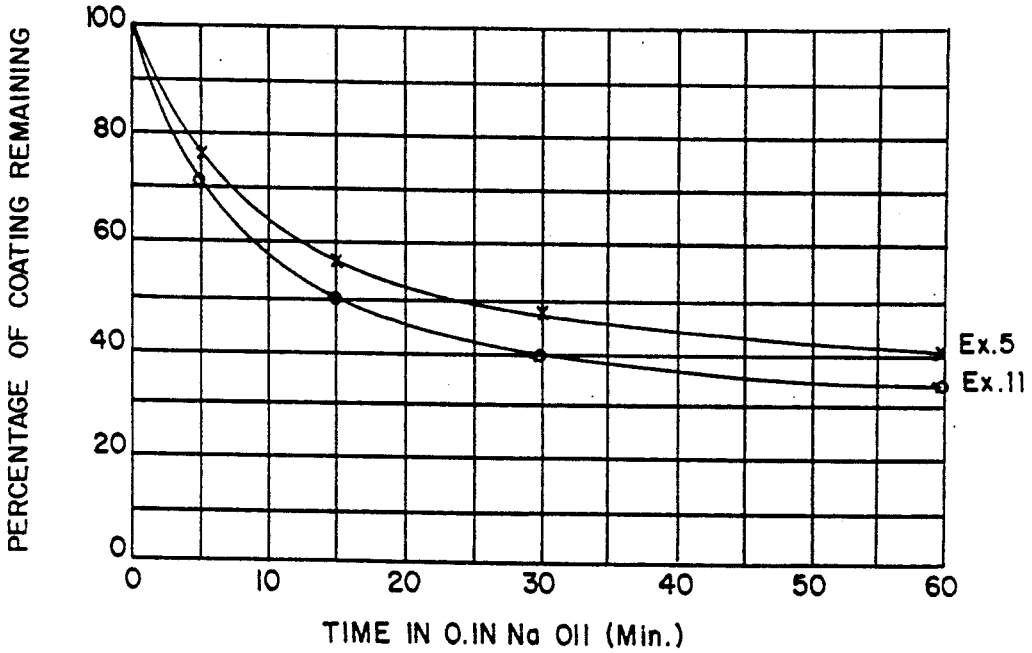
FIG. 15 graphically presents test data as in FIG. 11 as applied to electrozinc-iron panels.

Table XIII (below) and FIGS. 11–15 show that low zinc/high nickel compositions as represented by Example 5 are superior to low zinc/low nickel compositions when tested for solubility in alkali solutions. No real improvement in resistance to alkaline attack was shown on steel panels; however, resistance to alkaline attack on pure zinc substrates, such as hot-dip galvanized and electrozinc, is substantially increased with higher nickel content bath. Galvanneal shows no increase in the resistance to alkaline attack based upon the nickel content. Electrozinc-iron shows a slight increase in resistance.

TABLE XIII

Alkaline Solubilities of Phosphate Coatings

| Type of Phosphate | Percentage of Coating Insoluble in Alkali* | |
|---|---|---|
| Concentrate Used | Low Zinc/ High Nickel Example 5 | Low Zinc/ Low Nickel Example 12 |
| Steel | 27% | 24% |
| Hot Dip Galvanized | 28% | 15% |
| Electrozinc | 38% | 17% |
| A01 Galvanneal | 36% | 37% |
| Electrozinc-Iron | 32% | 26% |

*Solubilities of the galvanized products are higher than expected because of a redeposition of white powder associated with attack on the substrate. Spray phosphate coatings.

Figure 16:
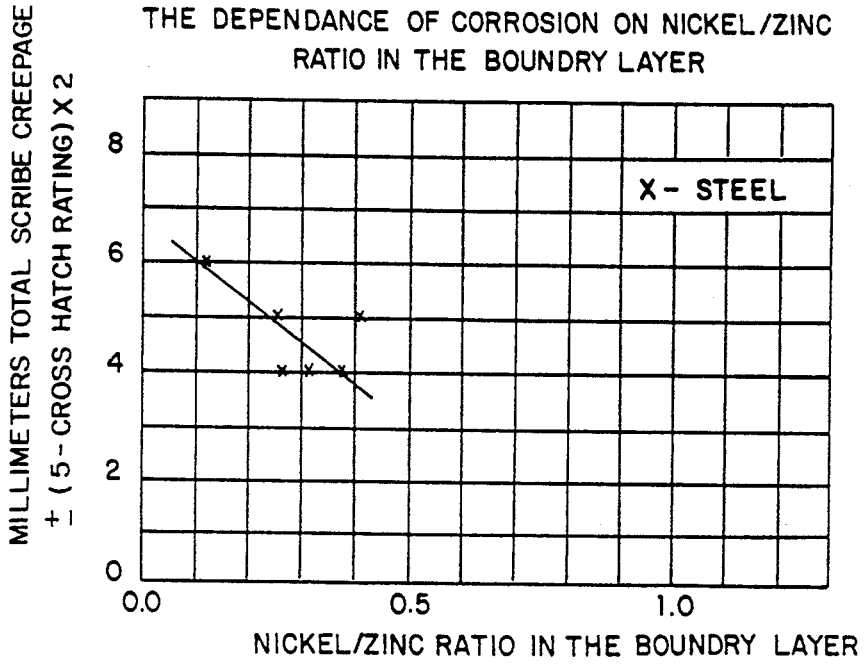
FIG. 16 graphically presents the dependence of corrosion and paint adhesion on the nickel to zinc ratio in the boundary layer as applied to steel panels.
Figure 17:
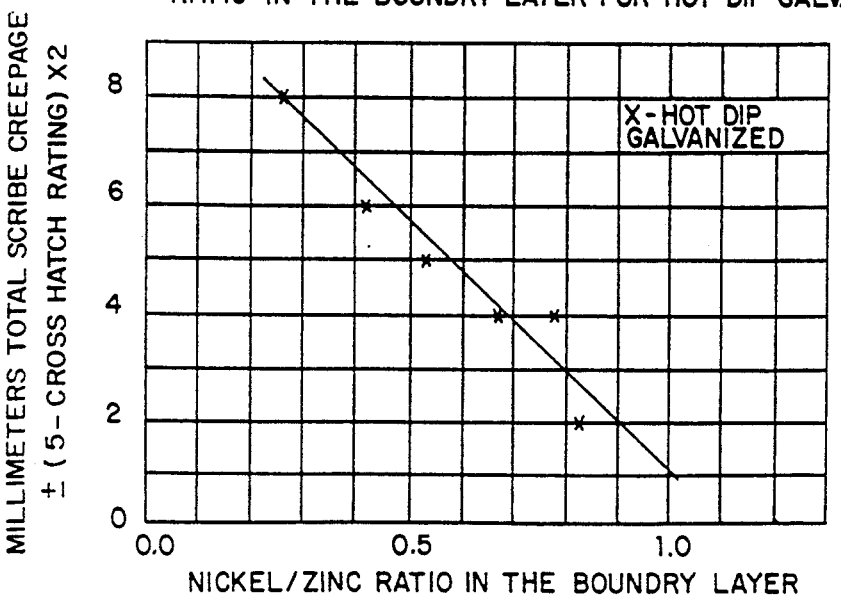
FIG. 17 graphically presents test data as in FIG. 16 as applied to hot-dip galvanized panels.
Figure 18:
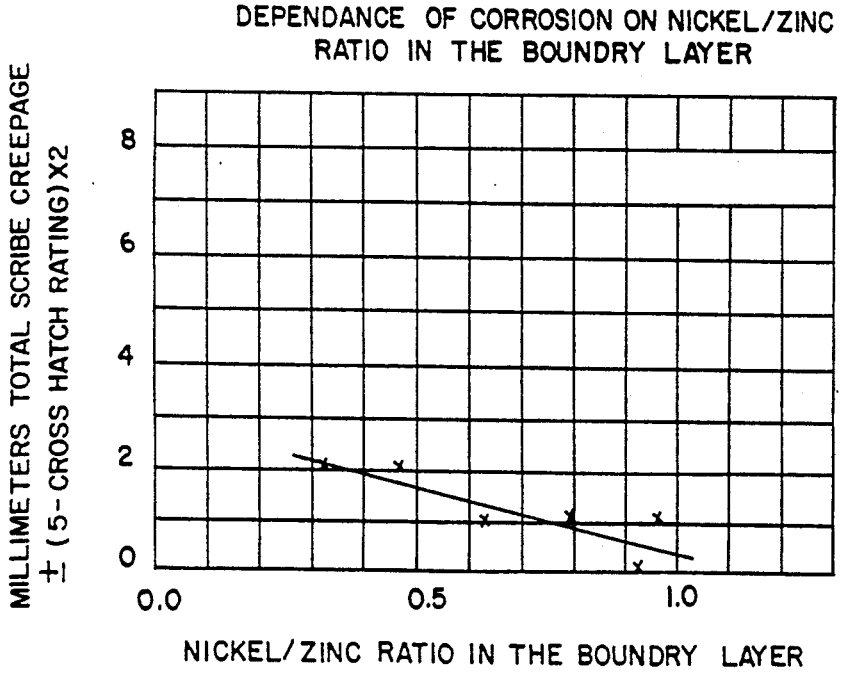
FIG. 18 graphically presents test data as in FIG. 16 as applied to electrozinc panels.
Figure 19:
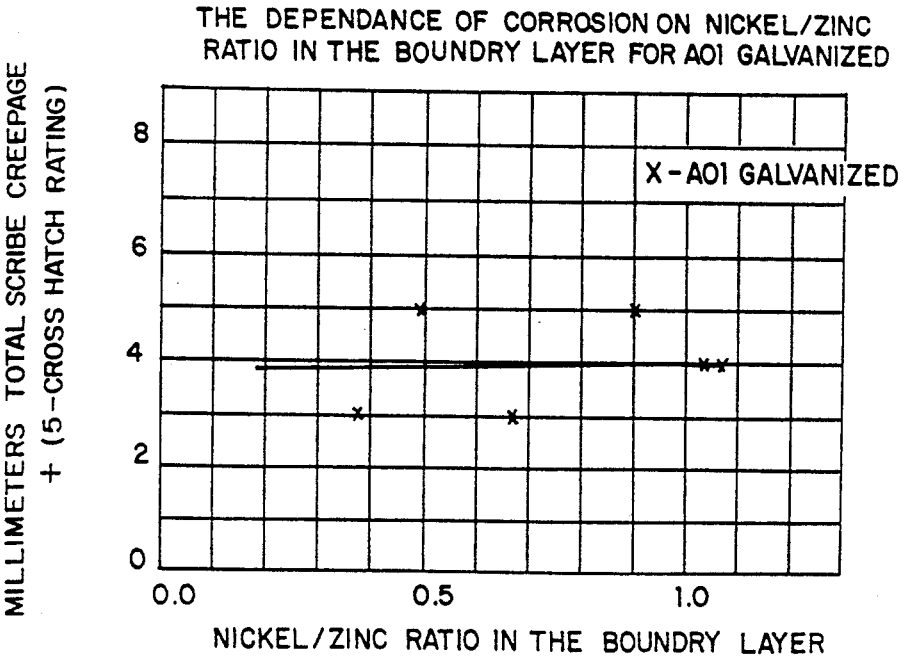
FIG. 19 graphically presents test data as in FIG. 16 as applied to galvanneal panels.
Figure 20:
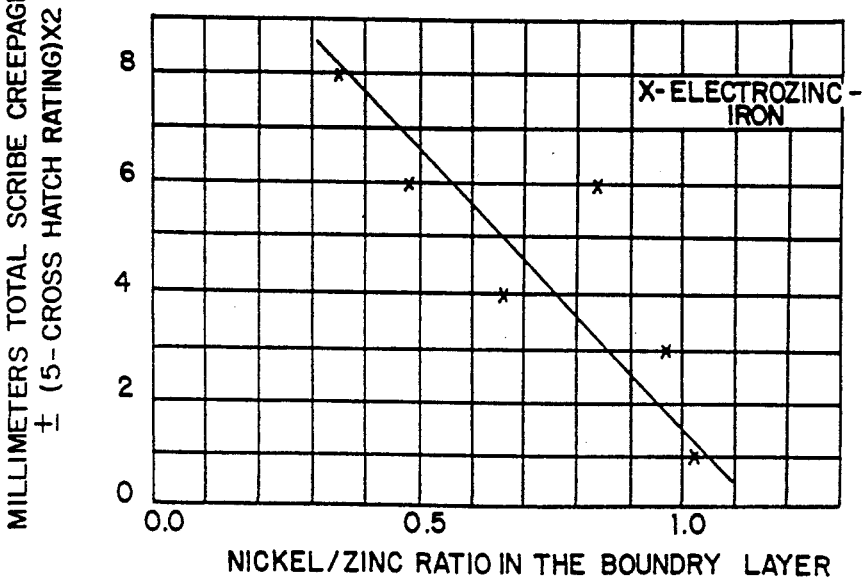
FIG. 20 graphically presents test data as in FIG. 16 as applied to electrozinc-iron panels.
Figure 21:
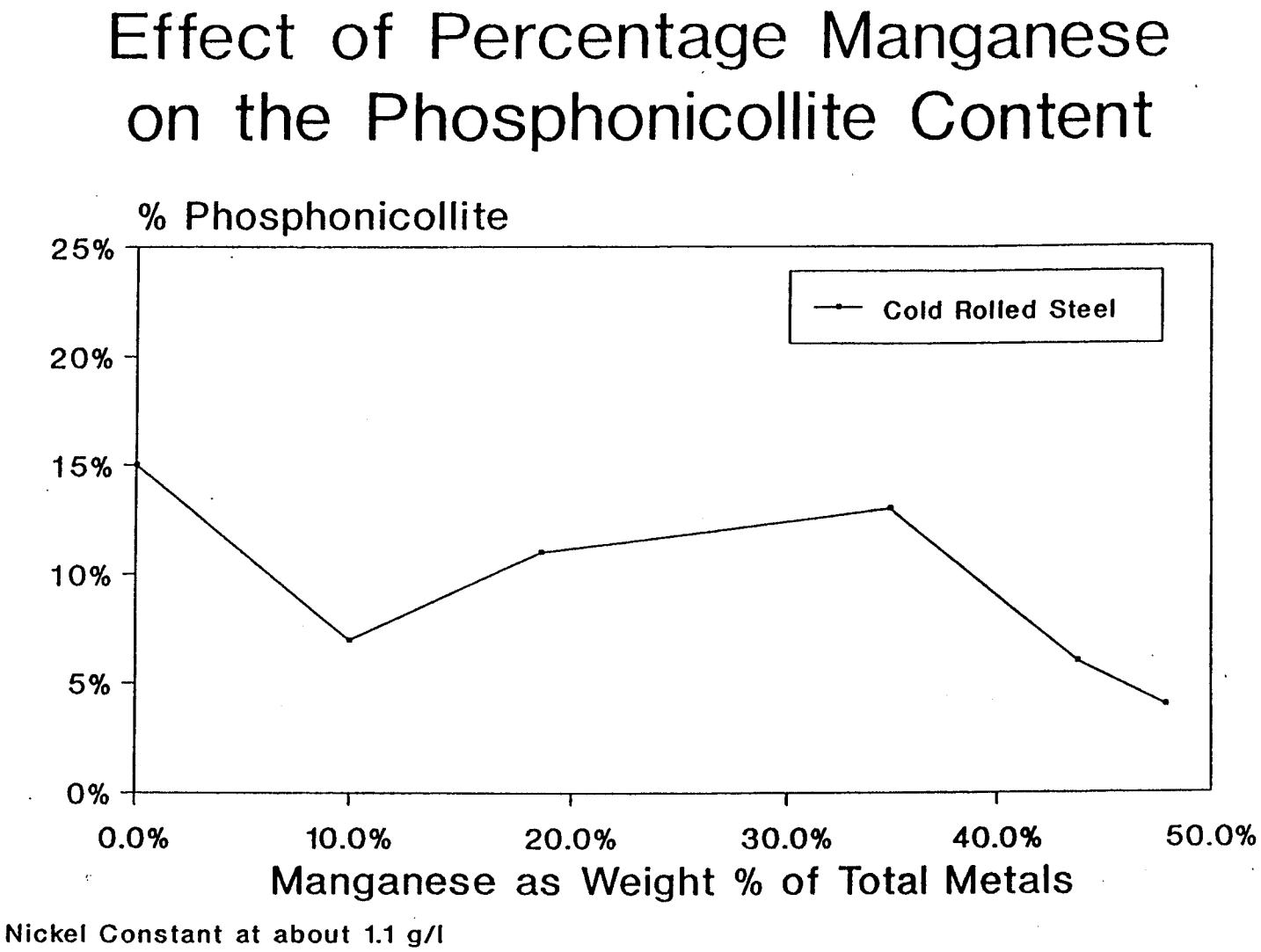
FIG. 21 graphically represents data from Tables XXVI to XXX relating the nickel content of a phosphate coating relative to the manganese concentration in the corresponding bath. The coatings are applied to cold rolled steel panels.
Figure 22:
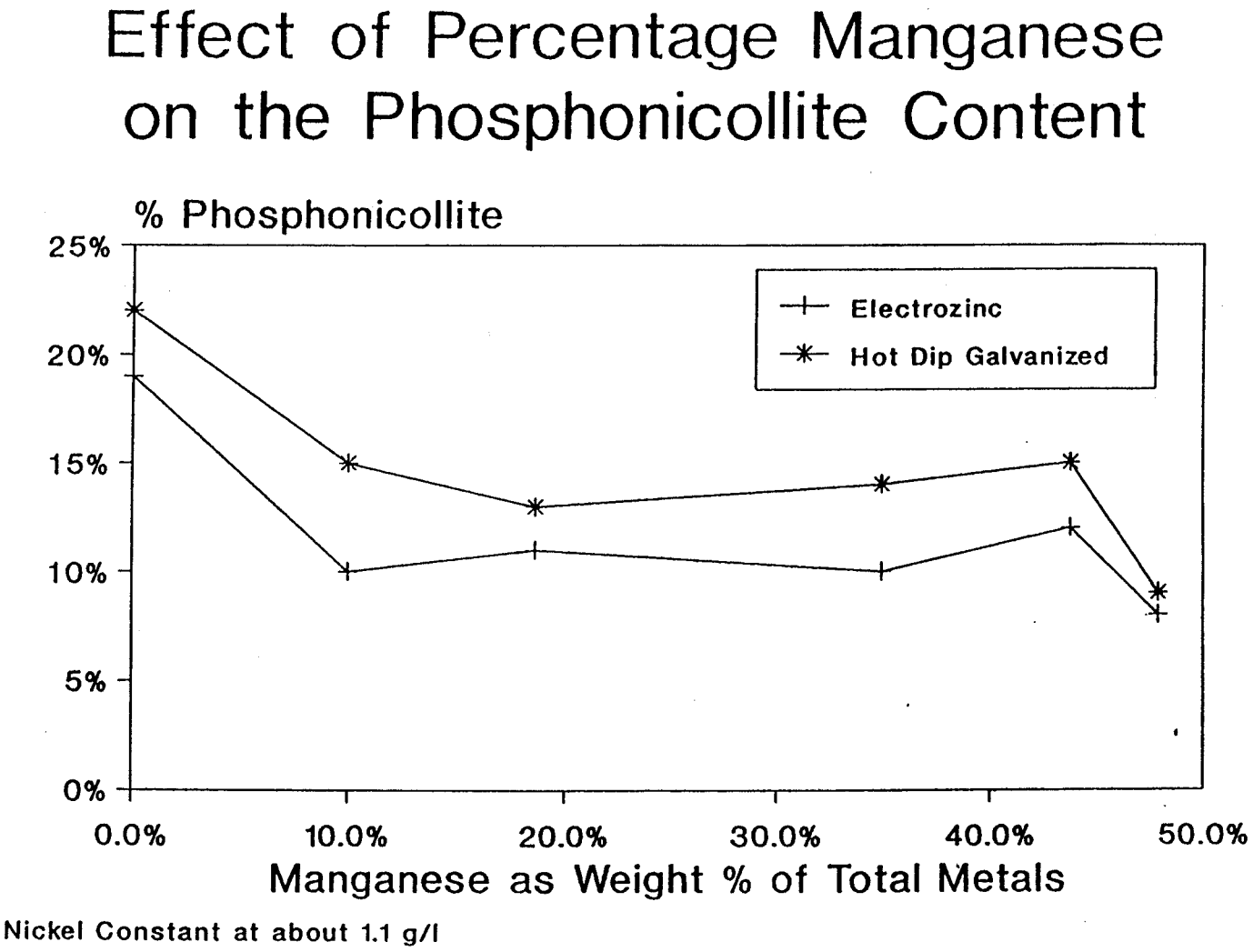
FIG. 22 graphically represents test data as in FIG. 21 as applied to electrozinc hot-dip galvanized panels.
Figure 23:
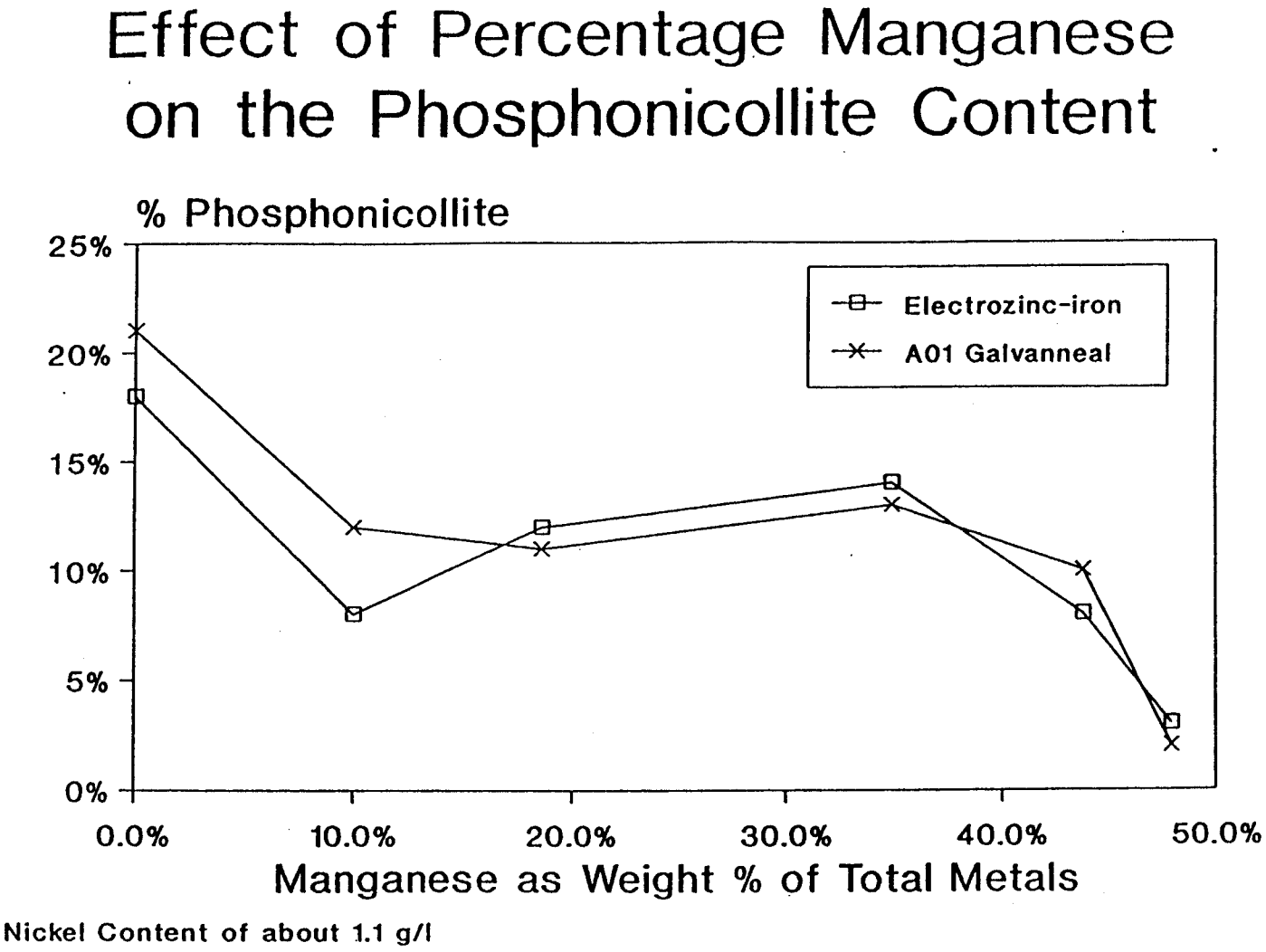
FIG. 23 graphically represents test data as in FIG. 21 as applied to electrozinc-iron and galvanneal panels.
Figure 24:
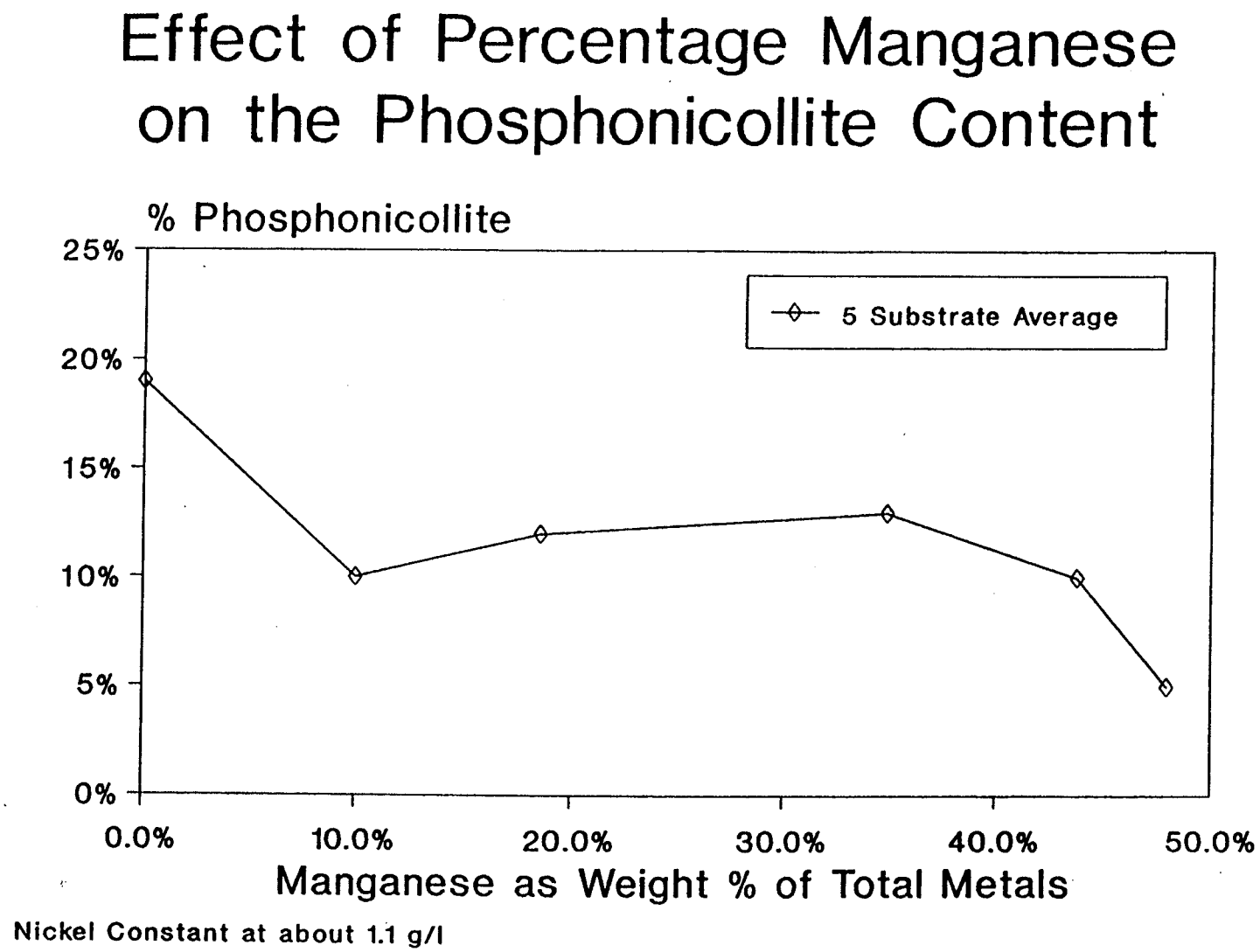
FIG. 24 graphically represents test data as in FIG. 21 as derived from a five-substrate average of the panel.

FIGS. 16–20 show that higher nickel/zinc ratios in the boundary layer can be correlated with decreased corrosion and/or paint adhesion loss. Electrozinc, hot-dip galvanized and, to a lesser extent, electrozinc-iron all show a decrease in alkaline solubility at higher nickel/zinc rations, and all show a decrease in corrosion and/or paint loss. AOl galvanneal does not show a decrease in alkaline solubility or a decrease in corrosion and paint loss due to a higher nickel to zinc ratio in the boundary layer. No significant changes are noted in the alkaline solubility because there is such a small change in the nickel/zinc ratio in the boundary layer. It is interesting to note that the data available suggests that if the nickel/zinc ratio for steel were raised, then it would improve the painted corrosion resistance or paint adhesion.

ACCELERATED TESTING FOR NICKEL AND FLUORIDE

The coating compositions of Examples 13 and 14, having different levels of ammonium bifluoride, were applied to a cold-rolled steel and hot-dip galvanized as well as electrozinc substrates. The test results show that high nickel phosphate baths based on low zinc/high nickel are superior to phosphate baths having low zinc/low nickel for steel, hot-dip galvanized and electrozinc. Tables XIV and XV (below) show that fluoride does not substantially affect the quality of the phosphate coating for a high nickel bath over the range of 0–400 ppm.

TABLE XIV

Accelerated Testing for Nickel and Fluoride+

| | | GSC | | | | FSC | | | |
|---|---|---|---|---|---|---|---|---|---|
| | | Low Zinc Low Nickel Example 13 | | Low Zinc High Nickel Example 14 | | Low Zinc Low Nickel Example 13 | | Low Zinc High Nickel Example 14 | |
| Fluoride ppm | Substrate | Scribe (mm) | Cross Hatch | Scribe (mm) | Cross Hatch | Scribe (mm) | Cross Hatch | Scribe (mm) | Cross Hatch |
| 0 | CRS | 5 mm | 5 | 5 mm | 5 | 5 mm | 5 | 3 mm | 5 |
| 185 | CRS | 5 mm | 5 | 5 mm | 5 | 4 mm | 5 | 2 mm | 5 |
| 385 | CRS | 5 mm | 5 | 4 mm | 5 | 5 mm | 5 | 2 mm | 5 |
| 590 | CRS | 6 mm | 5 | 5 mm | 5 | 4 mm | 5 | 4 mm | 5 |
| 780 | CRS | 5 mm | 5 | 4 mm | 5 | 4 mm | 5 | 4 mm | 5 |
| 975 | CRS | 5 mm | 5 | 5 mm | 5 | 4 mm | 5 | 3 mm | 4+ |
| 0 | HDG | 4 mm | 4+ | 2 mm | 4+ | 8 mm | 4+ | 7 mm | 5 |
| 185 | HDG | 4 mm | 3+ | 2 mm | 5 | 8 mm | 3+ | 7 mm | 5 |
| 385 | HDG | 4 mm | 4+ | 2 mm | 5 | 8 mm | 1 | 7 mm | 5 |
| 590 | HDG | 5 mm | 3+ | 2 mm | 5 | 8 mm | 1 | 6 mm | 5 |
| 780 | HDG | 5 mm | 3+ | 2 mm | 5 | 8 mm | 0 | 6 mm | 5 |
| 975 | HDG | 4 mm | 3+ | 2 mm | 5 | 8 mm | 0 | 6 mm | 4+ |
| 0 | EZ | 2 mm | 5 | 2 mm | 5 | 5 mm | 5 | 5 mm | 5 |
| 185 | EZ | 2 mm | 5 | 2 mm | 5 | 6 mm | 5 | 4 mm | 5 |
| 385 | EZ | 2 mm | 5 | 1 mm | 5 | 4 mm | 5 | 3 mm | 5 |
| 590 | EZ | 2 mm | 5 | 1 mm | 5 | 4 mm | 5 | 4 mm | 5 |
| 780 | EZ | 2 mm | 4 | 1 mm | 5 | 5 mm | 4+ | 4 mm | 5 |
| 975 | EZ | 2 mm | 5 | 2 mm | 5 | 5 mm | 5 | 4 mm | 2 |

+ Spray Phosphate

TABLE XV

Accelerated Testing for Nickel and Fluoride+

| | | ASC | | | | ODS | | | |
|---|---|---|---|---|---|---|---|---|---|
| | | Low Zinc Low Nickel Example 13 | | Low Zinc High Nickel Example 14 | | Low Zinc Low Nickel Example 13 | | Low Zinc High Nickel Example 14 | |
| Fluoride ppm | Substrate | Scribe (mm) | Cross Hatch | Scribe (mm) | Cross Hatch | Scribe (mm) | Cross Hatch | Scribe (mm) | Cross Hatch |
| 0 | CRS | 11 mm | 5 | 8 mm | 5 | 14 mm | 4 | 5 mm | 5 |
| 185 | CRS | 8 mm | 5 | 7 mm | 5 | 9 mm | 4 | 6 mm | 5 |
| 385 | CRS | 8 mm | 5 | 7 mm | 5 | 8 mm | 4+ | 7 mm | 4+ |
| 590 | CRS | 9 mm | 4+ | 9 mm | 5 | 13 mm | 4 | 11 mm | 4+ |
| 780 | CRS | 6 mm | 5 | 11 mm | 5 | 10 mm | 4+ | 10 mm | 4+ |
| 975 | CRS | 8 mm | 5 | 10 mm | 5 | 9 mm | 4+ | 7 mm | 4+ |
| 0 | HDG | 3 mm | 4 | 2 mm | 4+ | 1 mm | 3 | 0 mm | 3 |
| 185 | HDG | 3 mm | 2 | 3 mm | 4+ | 3 mm | 2 | 0 mm | 3 |
| 385 | HDG | 3 mm | 2 | 2 mm | 3+ | 2 mm | 1+ | 0 mm | 3 |
| 590 | HDG | 3 mm | 2 | 3 mm | 5 | 5 mm | 2 | 1 mm | 3 |

TABLE XV-continued

| | | Accelerated Testing for Nickel and Fluoride+ | | | | | | | |
|---|---|---|---|---|---|---|---|---|---|
| | | ASC | | | | ODS | | | |
| | | Low Zinc Low Nickel Example 13 | | Low Zinc High Nickel Example 14 | | Low Zinc Low Nickel Example 13 | | Low Zinc High Nickel Example 14 | |
| Fluoride ppm | Substrate | Scribe (mm) | Cross Hatch | Scribe (mm) | Cross Hatch | Scribe (mm) | Cross Hatch | Scribe (mm) | Cross Hatch |
| 780 | HDG | 2 mm | 2 | 3 mm | 5 | Failure | | 1 mm | 3 |
| 975 | HDG | 3 mm | 2+ | 3 mm | 4+ | Failure | | 1 mm | 4 |
| 0 | EZ | 2 mm | 4+ | 1 mm | 5 | 0 mm | 4 | 0 mm | 4+ |
| 185 | EZ | 3 mm | 5 | 2 mm | 5 | 1 mm | 3 | 0 mm | 5 |
| 385 | EZ | 3 mm | 4+ | 2 mm | 5 | 1 mm | 3 | 0 mm | 5 |
| 590 | EZ | 2 mm | 5 | 2 mm | 5 | 1 mm | 4 | 0 mm | 5 |
| 780 | EZ | 2 mm | 4+ | 2 mm | 5 | 1 mm | 3 | 0 mm | 5 |
| 975 | EZ | 3 mm | 4 | 2 mm | 5 | 1 mm | 3+ | 0 mm | 4+ |

+ Spray Phosphate

ZINC MANGANESE NICKEL PHOSPHATE COMPOSITIONS

Additional testing has been conducted to determine the effectiveness of adding manganese and nickel to zinc phosphate coating solution having preferred ratios of zinc to nickel. Also, formulations incorporating nitrite, hydrazine, and hydrozylamine have the effect of reducing the manganese precipitation and producing a clearer bath solution of the concentrate.

The compositions were tested as previously described and are listed above as Examples 15 and 16.

TEST RESULTS OF MANGANESE ZINC PHOSPHATES

Examples 10, 12, 15 and 16 were compared to determine the effect of the addition of manganese to both a low zinc/low nickel composition as represented by Example 12 and a low zinc/high nickel composition as represented by Example 10. The nickel and manganese contents of manganese-containing zinc phosphate coatings and comparable panels from non-manganese baths are shown in Table XVI below:

When manganese is included in the bath, the nickel content of the coating drops. This is because the manganese in the boundary layer also competes with the nickel for inclusion in the phosphate coating. As will be shown below, the addition of manganese to the bath does not cause a drop in performance, but in some instances actually shows improvements. Since manganese is generally less expensive than nickel, a manganese/nickel/zinc phosphate bath may be the most cost-effective method of improving resistance to alkaline solubility. Quantitative testing of the alkaline solubility of manganese/nickel/zinc phosphate coatings is not possible since the ammonium dichromate stripping method was not effective in removing the coating. However, qualitatively the decrease in alkaline solubility of manganese/nickel/zinc phosphate is clearly shown by the increased resistance to the alkaline stripping method that was effective on nickel/zinc phosphate coatings.

CORROSION AND ADHESION TEST RESULTS

The manganese/nickel/zinc phosphate coatings were tested by the indoor scan test with the results shown in Table XVII below:

TABLE XVI

| | Composition of Manganese Zinc Phosphates* | | | |
|---|---|---|---|---|
| | Type of Phosphate | | | |
| | Low Zinc Low Nickel High Manganese | | Low Zinc High Nickel High Manganese | |
| Concentrates Used | Example 12 | Example 15 | Example 10 | Example 16 |
| Nickel Content | | | | |
| Steel | 1.0% | 0.6% | 1.5% | 1.0% |
| Hot Dip Galvanized | 0.9% | 0.7% | 1.6% | 1.1% |
| Electrozinc | 0.8% | 0.7% | 1.2% | 1.0% |
| Electrozinc-Iron | 0.9% | 0.7% | 1.4% | 1.0% |
| Manganese Content | | | | |
| Steel | — | 3.0% | — | 2.6% |
| Hot Dip Galvanized | — | 2.9% | — | 2.6% |
| Electrozinc | — | 2.7% | — | 2.0% |
| Electrozinc-Iron | — | 3.3% | — | 2.4% |

TABLE XVII

| | 140° F. IDS Test Results* | | | | | | | |
|---|---|---|---|---|---|---|---|---|
| | Type of Phosphate | | | | | | | |
| | Low Zinc Low Nickel Example 12 | | Low Zinc Low Nickel High Manganese Example 15 | | Low Zinc High Nickel Example 10 | | Low Zinc High Nickel High Manganese Example 16 | |
| Concentrates Used | Scribe (mm) | Cross Hatch | Scribe (mm) | Cross Hatch | Scribe (mm) | Cross Hatch | Scribe (mm) | Cross Hatch |
| Steel | 3 mm | 5 | 4 mm | 5 | 3 mm | 5 | 3 mm | 5 |

TABLE XVII-continued

| | 140° F. IDS Test Results* | | | | | | | |
|---|---|---|---|---|---|---|---|---|
| | Type of Phosphate | | | | | | | |
| | Low Zinc Low Nickel Example 12 | | Low Zinc Low Nickel High Manganese Example 15 | | Low Zinc High Nickel Example 10 | | Low Zinc High Nickel High Manganese Example 16 | |
| Concentrates Used | Scribe (mm) | Cross Hatch | Scribe (mm) | Cross Hatch | Scribe (mm) | Cross Hatch | Scribe (mm) | Cross Hatch |
| Hot Dip Galvanized | 4 mm | 5 | 4 mm | 5 | 3 mm | 5 | 3 mm | 5 |
| Electrozinc | 4 mm | 4+ | 3 mm | 5 | 2 mm | 5 | 2 mm | 5 |
| Electrozinc-Iron | 1 mm | 4 | 1 mm | 4+ | 0 mm | 4+ | 1 mm | 4+ |

+ Immersion Phosphating

Table XVII shows that the test results for low zinc/-low nickel and low zinc/high nickel compositions having manganese added thereto are substantially equivalent as applied to steel, hot-dip galvanized, electrozinc and electrozinc-iron substrates. The exception is that electrozinc shows improvement with additions of manganese to the low nickel bath. The test results were obtained on panels that were coated by immersion phosphating.

NITROGEN-REDUCING AGENTS

Substantially equivalent phosphate concentrate having manganese oxide were prepared using a reducing agent to limit precipitation during manufacture. Some effective reducing agents were nitrite, hydrazine, and hydrozylamine when added in the proportions shown below in Table XVIII:

TABLE VIII

| Effect of Nitrogen-Reducing Agents on Manganese Phosphate | | | | |
|---|---|---|---|---|
| | None | Nitrite | Hydrazine | Hydroxylamine |
| Water | 46.4% | 46.4% | 46.0% | 46.2% |
| Phosphoric Acid | 40.2% | 40.2% | 39.9% | 40.0% |
| Sodium Nitrite | — | 0.38% | — | — |
| Hydrazine Sulfate | — | — | 0.75% | — |
| Hydroxylamine Sulfate | — | — | — | 0.75% |
| Manganese Oxide | 9.10% | 9.10% | 9.03% | 9.06% |
| Nitric Acid | 3.72% | 3.49% | 3.76% | 3.47% |
| Nickel Oxide | 0.45% | 0.45% | 0.45% | 0.45% |
| Solution Clarity | muddy brown | slightly cloudy | clear | clear |
| Precipitate | heavy brown | slightly brown | none | none |

Table XVIII and all other concentrates in this section show the ingredients in the order added.

The results of the above comparative test indicates that the hydrazine and hydrozylamine reducing agents were completely effective in obtaining a clear solution and eliminating precipitation from the baths. The sodium nitrite was moderately effective in clarifying the solution and partially effective in that it reduced the degree of precipitation. Therefore, the addition of sufficient amounts of nitrogen containing reducing agents can eliminate or greatly reduce the precipitation and clarity problems. The quantity of reducing agent required is expected to be dependent upon the purity of the manganese alkali. The quantity of reducing agent is limited primarily by coat considerations. The reducing agent is preferably added prior to the manganese and prior to any oxidizing agent.

Another key factor is the ratio of manganese to phosphoric acid. Table XIX shows the effect of variations of the manganese/phosphoric acid ratio on the clarity of the concentrate.

TABLE XIX

| EFFECT OF MANGANESE: PHOSPHORIC ACID RATIO | | | | |
|---|---|---|---|---|
| Name of Raw Material | Example XVII | Example XVIII | Example XIX | Example XX |
| Water | 41.1% | 42.3% | 43.5% | 46.5% |
| Phosphoric Acid (75%) | 48.0% | 46.8% | 45.5% | 42.3% |
| Hydroxylamine Sulfate | 0.52% | 0.52% | 0.52% | 0.53% |
| Manganese Oxide | 10.4% | 10.4% | 10.5% | 10.7% |
| Clarity | Clear | Slightly Cloudy | Cloudy | Voluminous White ppt. |
| $Mn:H_3PO_4$ Molar Ratio | 0.378:1 | 0.388:1 | 0.403:1 | 0.441:1 |

Clearly, the manganese:phosphoric acid molar ratio should be between 0.388:1 and 0.001:1. As in all concentrates, the less water added the better as long as no precipitate is formed. Table XX shows the effect of increasing the concentration of the concentrate. One of the traits of manganese phosphate concentrates is that they form moderately stable supersaturated solutions. Thus, in order to determine whether or not a solution has been formed that will not precipitate during storage, the concentrates must be seeded.

TABLE XX

| EFFECT OF CONCENTRATION | | | |
|---|---|---|---|
| Name of Raw Material | Example XXI | Example XXII | Example XXIII |
| Water | 31.8% | 36.4% | 41.1% |
| Phosphoric Acid (75%) | 55.6% | 51.8% | 48.0% |
| Hydroxylamine Sulfate | 0.60% | 0.56% | 0.52% |
| Manganese Oxide | 12.0% | 11.2% | 10.4% |
| Manganese Concentration | 2.42 m/l | 2.24 m/l | 2.06 m/l |
| $Mn:H_3PO_4$ Molar Ratio | 0.388:1 | 0.388:1 | 0.388:1 |
| Initial Solubility | All Soluble | All Soluble | All Soluble |
| Solubility after Seeding | Massive Precipitation | All Soluble | All Soluble |

Thus, the concentration of manganese should be 2.24 M/L or below.

ADDITIONAL EXAMPLES

The following illustrates the incorporation of high level of manganese into a coating to form a nickel-manganese-zinc conversion coating and the comparison thereof to art-related compositions. As afore-stated, in theory, the inclusion of nickel in a coating may be controlled by controlling the concentration of the divalent metal ion at the boundary layer. When manganese is included in the bath, it has been believed that nickel content of the bath drops. Surprisingly, it has been found that in certain concentrations the nickel content is not so adversely affected.

An improved coating composition of this invention was prepared by using Concentrates A and B, hereinbelow, followed by the addition of a manganese concentrate as shown in Example XXII followed by addition of more manganese to constitute a bath having from 800 to 1300 ppm manganese.

| CONCENTRATE A | |
|---|---|
| 1. Water | 20% |
| 2. Phosphoric Acid (75%) | 38% |
| 3. Nitric Acid | 21% |
| 4. Zinc Oxide | 5% |
| 5. Nickel Oxide | 8% |
| 6. Sodium Oxide | 4% |
| 7. Ammonium Bifluoride | 2% |
| 8. Sodium salt of 2 ethyl hexyl sulfate | 0.3% |
| 9. Nitro Benzene Sulfonic Acid | trace % |

| CONCENTRATE B | |
|---|---|
| 1. Water | 34% |
| 2. Phosphoric Acid (75%) | 28% |
| 3. Nitric Acid | 5% |
| 4. Zinc Oxide | 13% |
| 5. Nickel Oxide | 20% |

As used herein, all percentages are percent by weight and "trace" is about 0.05 to 0.1%.

Tables XXVI to XXXI hereinbelow illustrate the composition of the improved phosphate coatings of this invention and their performance properties in comparison with art-related compositions. The coatings with increasing levels of manganese were applied to five types of substrates. Decrease in corrosion was observed at manganese concentrations of about 800 to 1300 ppm. Surprisingly, it has been found that the higher levels of manganese do not adversely affect the formation of Phosphonicollite. At the high levels, manganese can be employed at about 15 to 50 percent, preferably above 20 percent and typically from about 35 to 50 percent (on cold rolled steel) based on the weight of the divalent metals.

TABLE XXI

CRS

| Zn (ppm) | Ni (ppm) | Mn (ppm) | Sodium Present as Sodium Phosphate (g/l) | Na:Zn Ratio | SPRAY Scribe Creep | SPRAY Cross Hatch | SPRAY % Paint Loss | IMMERSION Scribe Creep | IMMERSION Cross Hatch | IMMERSION % Paint Loss |
|---|---|---|---|---|---|---|---|---|---|---|
| 765 | 965 | 0 | 3.07 | 8.0:2 | 7 mm | 5 | 10% | 6 mm | 5 | 7% |
| 610 | 970 | 750 | 2.57 | 8.4:2 | 6 mm | 5 | 15% | 6 mm | 5 | 11% |
| 940 | 1080 | 0 | .43 | 1.0:2 | 6 mm | 5 | 27% | 6 mm | 5 | 12% |
| 840 | 950 | 670 | .76 | 1.8:2 | 7 mm | 5 | 18% | 6 mm | 5 | 10% |
| 770 | 340 | 0 | 4.52 | 11.7:2 | 7 mm | 5 | 20% | 6 mm | 5 | 9% |
| 820* | 370* | 820* | 3.05* | 7.4:2 | 7 mm | 5 | 17% | 6 mm | 6 | 10% |
| 765 | 340 | 750 | 3.19 | 8.3:2 | 7 mm | 5 | 12% | 6 mm | 5 | 9% |
| 1620 | 485 | 0 | 0.90 | 1.1:2 | 8 mm | 3 | 70% | 6 mm | 5 | 28% |
| 1350 | 320 | 730 | 1.09 | 1.6:2 | 8 mm | 4 | 22% | 5 mm | 5 | 19% |

*No fluoride ions in bath.

TABLE XXII

HDG

| Zn (ppm) | Ni (ppm) | Mn (ppm) | Sodium Present as Sodium Phosphate (g/) | Na:Zn Ratio | SPRAY Scribe Creep | SPRAY Cross Hatch | SPRAY % Paint Loss | IMMERSION Scribe Creep | IMMERSION Cross Hatch | IMMERSION % Paint Loss |
|---|---|---|---|---|---|---|---|---|---|---|
| 765 | 965 | 0 | 3.07 | 8.0:2 | 3 mm | 5 | 1% | 2 mm | 5 | 0% |
| 610 | 970 | 750 | 2.57 | 8.4:2 | 3 mm | 5 | 4% | 2 mm | 5 | 0% |
| 940 | 1080 | 0 | .43 | 1.0:2 | 3 mm | 5 | 6% | 2 mm | 5 | 0% |
| 840 | 950 | 670 | .76 | 1.8:2 | 2 mm | 5 | 1% | 2 mm | 5 | 0% |
| 770 | 340 | 0 | 4.52 | 11.7:2 | 3 mm | 5 | 4% | 3 mm | 5 | 3% |
| 820* | 370* | 820* | 3.05* | 7.4:2 | 3 mm | 5 | 4% | 3 mm | 5 | 1% |
| 765 | 340 | 750 | 3.19 | 8.3:2 | 3 mm | 5 | 1% | 3 mm | 5 | 0% |
| 1620 | 485 | 0 | 0.90 | 1.1:2 | 4 mm | 4 | 18% | 3 mm | 5 | 2% |
| 1350 | 320 | 730 | 1.09 | 1.6:2 | 4 mm | 5 | 10% | 3 mm | 5 | 1% |

*No fluoride ions in bath.

TABLE XXIII

EZn

| Zn (ppm) | Ni (ppm) | Mn (ppm) | Sodium Present as Sodium Phosphate (g/l) | Na:Zn Ratio | SPRAY Scribe Creep | SPRAY Cross Hatch | SPRAY % Paint Loss | IMMERSION Scribe Creep | IMMERSION Cross Hatch | IMMERSION % Paint Loss |
|---|---|---|---|---|---|---|---|---|---|---|
| 765 | 965 | 0 | 3.07 | 8.0:2 | 2 mm | 5 | 0% | 2 mm | 5 | 0% |
| 610 | 970 | 750 | 2.57 | 8.4:2 | 3 mm | 5 | 0% | 3 mm | 5 | 0% |
| 940 | 1080 | 0 | .43 | 1.0:2 | 2 mm | 5 | 0% | 2 mm | 5 | 0% |
| 840 | 950 | 670 | .76 | 1.8:2 | 3 mm | 5 | 0% | 3 mm | 5 | 0% |
| 770 | 340 | 0 | 4.52 | 11.7:2 | 3 mm | 5 | 0% | 2 mm | 5 | 3% |
| 820* | 370* | 820* | 3.05* | 7.4:2 | 3 mm | 5 | 0% | 3 mm | 5 | 0% |
| 765 | 340 | 750 | 3.19 | 8.3:2 | 3 mm | 5 | 0% | 3 mm | 5 | 0% |
| 1620 | 485 | 0 | 0.90 | 1.1:2 | 3 mm | 5 | 1% | 2 mm | 5 | 0% |

TABLE XXIII-continued

| | | | | EZn | | | | | | |
|---|---|---|---|---|---|---|---|---|---|---|
| | | | Sodium Present as | | SPRAY | | | IMMERSION | | |
| Zn (ppm) | Ni (ppm) | Mn (ppm) | Sodium Phosphate (g/l) | Na:Zn Ratio | Scribe Creep | Cross Hatch | % Paint Loss | Scribe Creep | Cross Hatch | % Paint Loss |
| 1350 | 320 | 730 | 1.09 | 1.6:2 | 3 mm | 5 | 0% | 3 mm | 5 | 0% |

*No fluoride ions in bath.

TABLE XXIV

| | | | | GALVANNEAL | | | | | | |
|---|---|---|---|---|---|---|---|---|---|---|
| | | | Sodium Present as | | SPRAY | | | IMMERSION | | |
| Zn (ppm) | Ni (ppm) | Mn (ppm) | Sodium Phosphate (g/l) | Na:Zn Ratio | Scribe Creep | Cross Hatch | % Paint Loss | Scribe Creep | Cross Hatch | % Paint Loss |
| 765 | 965 | 0 | 3.07 | 8.0:2 | 3 mm | 5 | 3% | 4 mm | 4 | 4% |
| 610 | 970 | 750 | 2.57 | 8.4:2 | 3 mm | 5 | 3% | 3 mm | 5 | 3% |
| 940 | 1080 | 0 | .43 | 1.0:2 | 3 mm | 5 | 3% | 3 mm | 5 | 4% |
| 840 | 950 | 670 | .76 | 1.8:2 | 4 mm | 5 | 3% | 4 mm | 4 | 4% |
| 770 | 340 | 0 | 4.52 | 11.7:2 | 3 mm | 5 | 5% | 3 mm | 5 | 7% |
| 820* | 370* | 820* | 3.05* | 7.4:2 | 3 mm | 5 | 2% | 3 mm | 4 | 3% |
| 765 | 340 | 750 | 3.19 | 8.3:2 | 4 mm | 5 | 1% | 3 mm | 4 | 2% |
| 1620 | 485 | 0 | 0.90 | 1.1:2 | 4 mm | 4 | 10% | 3 mm | 5 | 4% |
| 1350 | 320 | 730 | 1.09 | 1.6:2 | 2 mm | 4 | 6% | 3 mm | 4 | 3% |

*No fluoride ions in bath.

TABLE XXV

| | | | | EZn—Fe | | | | | | |
|---|---|---|---|---|---|---|---|---|---|---|
| | | | Sodium Present as | | SPRAY | | | IMMERSION | | |
| Zn (ppm) | Ni (ppm) | Mn (ppm) | Sodium Phosphate (g/l) | Na:Zn Ratio | Scribe Creep | Cross Hatch | % Paint Loss | Scribe Creep | Cross Hatch | % Paint Loss |
| 765 | 965 | 0 | 3.07 | 8.0:2 | 3 mm | 5 | 6% | 4 mm | 5 | 4% |
| 610 | 970 | 750 | 2.57 | 8.4:2 | 4 mm | 5 | 3% | 4 mm | 5 | 4% |
| 940 | 1080 | 0 | .43 | 1.0:2 | 4 mm | 5 | 7% | 4 mm | 5 | 5% |
| 840 | 950 | 670 | .76 | 1.8:2 | 4 mm | 5 | 3% | 3 mm | 5 | 5% |
| 770 | 340 | 0 | 4.52 | 11.7:2 | 5 mm | 5 | 8% | 5 mm | 5 | 6% |
| 820* | 370* | 820* | 3.05* | 7.4:2 | 4 mm | 5 | 4% | 5 mm | 5 | 5% |
| 765 | 340 | 750 | 3.19 | 8.3:2 | 4 mm | 5 | 4% | 5 mm | 5 | 4% |
| 1620 | 485 | 0 | 0.90 | 1.1:2 | 5 mm | 2 | 25% | 4 mm | 5 | 6% |
| 1350 | 20 | 30 | 1.09 | 1.6:2 | 5 mm | 4 | — | 5 mm | 2 | 6% |

*No fluoride ions in bath.

TABLE XXVI

| | | | | Cold Rolled Steel | | | | | | | | |
|---|---|---|---|---|---|---|---|---|---|---|---|---|
| | | | | COATING DESCRIPTION | | COATING COMPOSITION* | | | CORROSION TESTING | | | |
| BATH COMPOSITION (g/l) | | | | COATING WEIGHT | MOR- | % $Zn_2X(PO_4)_2\ 4H_2O$ WITH X AS | | | OUTDOOR SCAB 140° F. CYCLIC | | | |
| Zn | Ni | Mn | Mn**** | (mg/ft$^2$) | PHOLOGY | Fe | Ni | Mn | SCRIBE** (mm) | CROSS*** HATCH | SCRIBE** (mm) | CROSS*** HATCH |
| 0.73 | 1.02 | 0.00 | 0.0% | 113 | 4–5 u Needles | 45% | 15% | 0% | 8 mm | 5 | 2 mm | 5 |
| 0.73 | 1.08 | 0.20 | 10.0% | 93 | 4–6 u Rectangles | 34% | 7% | 22% | 8 mm | 5 | 2 mm | 5 |
| 0.67 | 1.12 | 0.41 | 18.6% | 84 | 2 u Round | 29% | 11% | 36% | 6 mm | 5 | 1 mm | 5 |
| 0.39 | 1.14 | 0.82 | 34.9% | 96 | 2–3 u Round | 14% | 13% | 62% | 3 mm | 5 | 1 mm | 5 |
| 0.52 | 1.15 | 1.30 | 43.8% | 87 | 2 u Round | 19% | 4% | 60% | 4 mm | 5 | 1 mm | 5 |
| 0.43 | 1.17 | 1.64 | 50.6% | 79 | 2 u Round | 15% | 6% | 66% | 7 mm | 5 | 1 mm | 5 |
| 0.69 | 1.18 | 1.63 | 47.9% | 86 | 2 u Round | 19% | 4% | 61% | 5 mm | 5 | 3 mm | 5 |

*Balance $Zn_3(PO_4)_2\ 4H_2O$
**Maximum Total Width from Scribe
***0–5 Rating - 5 = Best
****Weight % of Divalent Metals

TABLE XXVII

| BATH COMPOSITION (g/l) | | | | COATING DESCRIPTION | | Electrozinc COATING COMPOSITION* % $Zn_2X(PO_4)_2$ $4H_2O$ WITH X AS | | | CORROSION TESTING OUTDOOR SCAB 140° F. CYCLIC | | | |
|---|---|---|---|---|---|---|---|---|---|---|---|---|
| Zn | Ni | Mn | Mn**** | COATING WEIGHT (mg/ft²) | MORPHOLOGY | Fe | Ni | Mn | SCRIBE** (mm) | CROSS*** HATCH | SCRIBE** (mm) | CROSS*** HATCH |
| 0.73 | 1.02 | 0.00 | 0.0% | 246 | 1-3 u Needles | | 19% | 0% | 1 mm | 5 | 0 mm | 5 |
| 0.73 | 1.08 | 0.20 | 10.0% | 220 | 1-3 u Plates | | 10% | 13% | 0 mm | 5 | 0 mm | 5 |
| 0.67 | 1.12 | 0.41 | 18.6% | 248 | 1-3 u Plates | | 11% | 33% | 0 mm | 5 | 0 mm | 5 |
| 0.39 | 1.14 | 0.82 | 34.9% | 109 | 1-3 u Round | | 10% | 53% | 0 mm | 5 | 0 mm | 5 |
| 0.52 | 1.15 | 1.30 | 43.8% | 99 | 1 u Round-Square | | 12% | 64% | 0 mm | 5 | 0 mm | 5 |
| 0.43 | 1.17 | 1.64 | 50.6% | 105 | 1 u Round-Square | | 11% | 73% | 0 mm | 5 | 0 mm | 5 |
| 0.69 | 1.18 | 1.63 | 47.9% | 131 | 1 u Round-Square | | 8% | 66% | 0 mm | 5 | 0 mm | 5 |

*Balance $Zn_3(PO_4)_2$ $4H_2O$
**Maximum Total Width from Scribe
***0-5 Rating - 5 = Best
****Weight % of Divalent Metals

TABLE XXVIII

| BATH COMPOSITION (g/l) | | | | COATING DESCRIPTION | | Hot Dip Galvanized COATING COMPOSITION* % $Zn_2X(PO_4)_2$ $4H_2O$ WITH X AS | | | CORROSION TESTING OUTDOOR SCAB 140° F. CYCLIC | | | |
|---|---|---|---|---|---|---|---|---|---|---|---|---|
| Zn | Ni | Mn | Mn**** | COATING WEIGHT (mg/ft²) | MORPHOLOGY | Fe | Ni | Mn | SCRIBE** (mm) | CROSS*** HATCH | SCRIBE** (mm) | CROSS*** HATCH |
| 0.73 | 1.02 | 0.00 | 0.0% | 281 | 4-7 u Plates | | 22% | 0% | 0 mm | 5 | 0 mm | 5 |
| 0.73 | 1.08 | 0.20 | 10.0% | 254 | 4-5 u Rectangles | | 15% | 16% | 0 mm | 5 | 0 mm | 5 |
| 0.67 | 1.12 | 0.41 | 18.6% | 246 | 2-4 u Rectangles | | 13% | 32% | 0 mm | 5 | 0 mm | 5 |
| 0.39 | 1.14 | 0.82 | 34.9% | 148 | 1-2 u Round | | 14% | 56% | 0 mm | 5 | 0 mm | 5 |
| 0.52 | 1.15 | 1.30 | 43.8% | 181 | 2 u Round | | 15% | 62% | 0 mm | 5 | 0 mm | 5 |
| 0.43 | 1.17 | 1.64 | 50.6% | 127 | 2 u Round | | 9% | 63% | 0 mm | 5 | 0 mm | 5 |
| 0.69 | 1.18 | 1.63 | 47.9% | 183 | 2 u Round | | 9% | 66% | 0 mm | 5 | 0 mm | 5 |

*Balance $Zn_3(PO_4)_2$ $4H_2O$
**Maximum Total Width from Scribe
***0-5 Rating - 5 = Best
****Weight % of Divalent Metals

TABLE XXIX

| BATH COMPOSITION (g/l) | | | | COATING DESCRIPTION | | Electrozinc-Iron COATING COMPOSITION* % $Zn_2X(PO_4)_2$ $4H_2O$ WITH X AS | | | CORROSION TESTING OUTDOOR SCAB 140° F. CYCLIC | | | |
|---|---|---|---|---|---|---|---|---|---|---|---|---|
| Zn | Ni | Mn | Mn**** | COATING WEIGHT (mg/ft²) | MORPHOLOGY | Fe | Ni | Mn | SCRIBE** (MM) | CROSS*** HATCH | SCRIBE** (MM) | CROSS*** HATCH |
| 0.73 | 1.02 | 0.00 | 0.0% | 263 | 2-4 u Rectangles | | 18% | 0% | 2 mm | 5 | 0 mm | 5 |
| 0.73 | 1.08 | 0.20 | 10.0% | 221 | 2 u Square | | 8% | 13% | 2 mm | 5 | 0 mm | 5 |
| 0.67 | 1.12 | 0.41 | 18.6% | 179 | 2-3 u Square | | 12% | 30% | 2 mm | 5 | 0 mm | 5 |
| 0.39 | 1.14 | 0.82 | 34.9% | 125 | 2-4 u Square | | 14% | 43% | 2 mm | 5 | 0 mm | 5 |
| 0.52 | 1.15 | 1.30 | 43.8% | 119 | 2-4 u Square-Round | | 8% | 50% | 2 mm | 5 | 0 mm | 5 |
| 0.43 | 1.17 | 1.64 | 50.6% | 116 | 2-3 u Square-Round | | 3% | 47% | 2 mm | 5 | 0 mm | 5 |
| 0.69 | 1.18 | 1.63 | 47.9% | 109 | 2-3 u | | 3% | 50% | 2 mm | 5 | 0 mm | 5 |

TABLE XXIX-continued

| BATH COMPOSITION (g/l) | | | | COATING DESCRIPTION | | Electrozinc-Iron COATING COMPOSITION* % $Zn_2X(PO_4)_2$ $4H_2O$ WITH X AS | | | CORROSION TESTING OUTDOOR SCAB 140° F. CYCLIC | | | |
|---|---|---|---|---|---|---|---|---|---|---|---|---|
| Zn | Ni | Mn | Mn**** | COATING WEIGHT (mg/ft²) | MORPHOLOGY | Fe | Ni | Mn | SCRIBE** (MM) | CROSS*** HATCH | SCRIBE** (MM) | CROSS*** HATCH |
| | | | | | Round | | | | | | | |

*Balance $Zn_3(PO_4)_2$ $4H_2O$
**Maximum Total Width from Scribe
***0-5 Rating - 5 = Best
****Weight % of Divalent Metals

TABLE XXX

| BATH COMPOSITION (g/l) | | | | COATING DESCRIPTION | | 1½ Side Galvanized COATING COMPOSITION* % $Zn_2X(PO_4)_2$ $4H_2O$ WITH X AS | | | CORROSION TESTING OUTDOOR SCAB 140° F. CYCLIC | | | |
|---|---|---|---|---|---|---|---|---|---|---|---|---|
| Zn | Ni | Mn | Mn**** | COATING WEIGHT (mg/ft²) | MORPHOLOGY | Fe | Ni | Mn | SCRIBE** (MM) | CROSS*** HATCH | SCRIBE** (MM) | CROSS*** HATCH |
| 0.73 | 1.02 | 0.00 | 0.0% | 119 | 1-2 u Square | | 21% | 0% | 2 mm | 5 | 1 mm | 5 |
| 0.73 | 1.08 | 0.20 | 10.0% | 106 | 2-4 u Round | | 12% | 15% | 1 mm | 5 | 0 mm | 5 |
| 0.67 | 1.12 | 0.41 | 18.6% | 95 | 2-4 u Round | | 11% | 33% | 1 mm | 5 | 0 mm | 5 |
| 0.39 | 1.14 | 0.82 | 34.9% | 88 | 2-4 u Round | | 13% | 47% | 1 mm | 5 | 0 mm | 5 |
| 0.52 | 1.15 | 1.30 | 43.8% | 81 | 2-4 u Round | | 10% | 67% | 1 mm | 5 | 0 mm | 5 |
| 0.43 | 1.17 | 1.64 | 50.6% | 93 | 2-4 u Round | | 8% | 68% | 1 mm | 5 | 0 mm | 5 |
| 0.69 | 1.18 | 1.63 | 47.9% | 125 | 2-4 u Round | | 2% | 61% | 1 mm | 5 | 0 mm | 5 |

*Balance $Zn_3(PO_4)_2$ $4H_2O$
**Maximum Total Width from Scribe
***0-5 Rating - 5 = Best
****Weight % of Divalent Metals

TABLE XXXI

| BATH COMPOSITION (g/l) | | | | COATING DESCRIPTION | | 5 Substrate Average COATING COMPOSITION* % $Zn_2X(PO_4)_2$ $4H_2O$ WITH X AS | | | CORROSION TESTING OUTDOOR SCAB 140° F. CYCLIC | | | |
|---|---|---|---|---|---|---|---|---|---|---|---|---|
| Zn | Ni | Mn | Mn**** | COATING WEIGHT (mg/ft²) | MORPHOLOGY | Fe | Ni | Mn | SCRIBE** (MM) | CROSS*** HATCH | SCRIBE** (MM) | CROSS*** HATCH |
| 0.73 | 1.02 | 0.00 | 0.0% | 204 | 3-4 u Plates + | | 19% | 0% | 2.6 mm | 5 | 0.6 mm | 5 |
| 0.73 | 1.08 | 0.20 | 10.0% | 179 | 3-4 u Rectangles Square | | 10% | 16% | 2.2 mm | 5 | 0.4 mm | 5 |
| 0.67 | 1.12 | 0.41 | 18.6% | 170 | 2-3 u Square | | 12% | 33% | 1.8 mm | 5 | 0.2 mm | 5 |
| 0.39 | 1.14 | 0.82 | 34.9% | 113 | 2-3 u Round | | 13% | 52% | 1.2 mm | 5 | 0.2 mm | 5 |
| 0.52 | 1.15 | 1.30 | 43.8% | 113 | 2 u Round | | 10% | 61% | 1.4 mm | 5 | 0.2 mm | 5 |
| 0.43 | 1.17 | 1.64 | 50.6% | 104 | 2 u Round | | 7% | 63% | 2.0 mm | 5 | 0.2 mm | 5 |
| 0.69 | 1.18 | 1.63 | 47.9% | 127 | 2 u Round | | 5% | 61% | 1.6 mm | 5 | 0.6 mm | 5 |

*Balance $Zn_3(PO_4)_2$ $4H_2O$
**Maximum Total Width from Scribe
***0-5 Rating - 5 = Best
****Weight % of Divalent Metals Therefore, it is claimed:

1. A method of phosphate conversion coating metallic substrates selected from the group consisting of steel, zinc-coated steel, and aluminum comprising the steps of:

cleaning the surface of the substrates with an alkali cleaner;

conditioning the surface of the substrates with a titanium-containing aqueous solution;

coating the surface of the substrates with a solution consisting essentially of an aqueous solution of the constituents A, B, and C combined in the ratio of about 4 to 40 parts by weight A:2 parts by weight B:2 to 13 parts by weight C, and B is provided at a concentration of between about 300 and 1,000 ppm, wherein:

A is selected from the group consisting of potassium, sodium and ammonium ions present as a phosphate salt;

B is zinc ions; and

C is nickel and manganese;

applying said coating composition to the surface of the substrates at a temperature of between about 100° F. and 140° F. for between 30 and 300 seconds;

rinsing said substrate by applying a chromate rinse to the substrate and rinsing the substrate with water.

2. The method of claim 1 wherein the constituents are combined in a ratio of 4 to 40 parts by weight A:2 parts by weight B:4 to 13 parts by weight C wherein manganese is at least 15 percent by weight.

3. The method of claim 1 wherein said constituents are combined in a ratio of about from 8 to 20 parts by weight A:2 parts by weight B:6 to 10 parts by weight C, and the concentration of B is between about 500 to 700 ppm.

4. The method of claim 1 wherein said constituents are combined in a ratio of about from 10 parts by weight A:2 parts by weight B:8 by weight C, and the concentration of B is between about 500 to 700 ppm.

5. The method of claim 1 wherein the zinc ion concentration is between about 300 and 1000 ppm, the alkali metal ion concentration is between about 600 and 20,000 ppm, the nickel and manganese ion concentration is between about 1500 to 3000 ppm and the manganese ion concentration is about 400 to 1600 ppm.

6. The method of claim 1 wherein the aqueous solution has a zinc ion concentration of between about 500 and 700 ppm, an alkali metal concentration of between about 2000 and 7000 ppm, a nickel and manganese ion concentration of between about 1500 to 3500 ppm and a manganese ion concentration of about 35 to 50 weight percent of the weight of B+C.

7. The method of claim 1 wherein the concentration of C exceeds 1500 ppm.

* * * * *